US006770432B2

(12) United States Patent
Kawakami et al.

(10) Patent No.: US 6,770,432 B2
(45) Date of Patent: Aug. 3, 2004

(54) SILVER HALIDE EMULSION

(75) Inventors: Hiroshi Kawakami, Minami-Ashigara (JP); Haruyasu Nakatsugawa, Minami-Ashigara (JP); Osamu Yonekura, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 30 days.

(21) Appl. No.: 10/081,183

(22) Filed: Feb. 25, 2002

(65) Prior Publication Data

US 2002/0187444 A1 Dec. 12, 2002

(30) Foreign Application Priority Data

Feb. 26, 2001 (JP) ..... 2001-050272
Jan. 11, 2002 (JP) ..... 2002-005151

(51) Int. Cl.[7] ..... G03C 1/005; G03C 1/494
(52) U.S. Cl. ..... 430/567
(58) Field of Search ..... 430/567

(56) References Cited

U.S. PATENT DOCUMENTS 6,280,920 B1 * 8/2001 Maruyama et al. ..... 430/567
6,287,753 B1 * 9/2001 Ihama et al. ..... 430/467
6,534,257 B2 * 3/2003 Kikuchi ..... 430/567

FOREIGN PATENT DOCUMENTS

| | | |
|---|---|---|
| EP | 0 370 116 A1 | 5/1990 |
| JP | 11-125874 | 5/1999 |

* cited by examiner

*Primary Examiner*—Geraldine Letscher
(74) *Attorney, Agent, or Firm*—Sughrue Mion, PLLC

(57) ABSTRACT

A silver halide emulsion comprises silver halide grains. The variation coefficient of equivalent-circle diameters of all the silver halide grains is 40% or less. 70% or more of the total projected area of all the grains is accounted for by silver halide grains each satisfying the following requirements (i), (ii) and (iii):

(i) a silver iodobromide or silver iodochlorobromide tabular grain having (111) planes as main planes thereof, (ii) a thickness thereof is 0.1 $\mu$m or less, and (iii) surface iodide contents in the main plain thereof meeting the following relations:

$$Io<30 \text{ mol } \% \text{ and}$$

$$0.7Io<Is<1.3Io$$

wherein "Is" is an average value of surface iodide contents (Ip's) in the main plane of each grain and "Io" is an average value of the "Is" values of all the tabular grains.

20 Claims, No Drawings

SILVER HALIDE EMULSION

CROSS-REFERENCE TO RELATED APPLICATIONS

This application is based upon and claims the benefit of priority from the prior Japanese Patent Applications No. 2001-050272, filed Feb. 26, 2001; and No. 2002-005151, filed Jan. 11, 2002 the entire contents of both of which are incorporated herein by reference.

BACKGROUND OF THE INVENTION

1. Field of the Invention

The present invention relates to a silver halide emulsion and a silver halide photographic light-sensitive material using the same. More particularly, the invention relates to a silver halide emulsion that contains thin grains, exhibits high sensitivity, hard gradation and excellent pressure characteristic.

2. Description of the Related Art

In recent years, photographic emulsions comprising silver halide tabular grains have become to be used widely for the purpose of improving the sensitivity/graininess ratio of silver halide photographic light-sensitive emulsions. Recently, for the purpose of a further improvement in the sensitivity/graininess ratio, there is a tendency that the grain thickness of silver halide tabular grains becomes smaller and the area of main planes becomes larger. This tendency is based on the idea to enhance the photoabsorption to improve the sensitivity/graininess ratio by the adsorption of a large amount of a spectral sensitizing dye caused by the increase of the surface area of silver halide grains per unit volume. This idea is described in U.S. Pat. No. 4,956,269 and so on.

On the other hand, the silver halide composition distribution of silver halide grains is an important factor on which the performance of a silver halide emulsion depends. For a silver iodobromide emulsion or a silver chloroiodobromide emulsion, what is particularly important is in what portion of a silver halide grain and in how much content iodide is distributed. Many patent applications about this subject have been published. Examples thereof include silver halide grains having therein a multilayered structure comprising a plurality of portions differing in iodide content, disclosed in Jpn. Pat. Appln. KOKAI Publication No. (hereinafter referred to as JP-A-) 60-143331 and so on, and silver halide grains which contains iodide in a high content in their surfaces, disclosed in JP-A-63-106745 and so on. These techniques are believed to contribute to the enhancement of sensitivity, pressure characteristic and so on through prevention of photoelectrons and positive holes from their recombination and improvement of developability and optimum control of the adsorption condition of sensitizing dye.

Further, a technology to enhance sensitivity and pressure characteristic by locally forming a phase with a high iodide content during the formation of silver halide grains is widely used in this technical field. Particularly, the technology to intentionally introduce dislocation lines into silver halide grains by locally forming phases with a high iodide content has been studied in the art. JP-A-63-220238 discloses a method for introducing a dislocation line to a peripheral portion of a silver halide tabular grain. JP-A-1-102547 discloses a method for introducing a dislocation line in a main plane of a silver halide tabular grain.

In the fields of silver iodobromide emulsions and silver chloroiodobromide emulsions, using iodide as described above has become a practical technique. On the other hand, however, it has been pointed out that the degree of uniformity of iodide content between grains of silver halide easily has an effect on photographic properties of silver halide emulsions containing iodide. Some patent applications about this fact, for example, JP-A's-2-256043 and 11-15089, have been published.

These patent applications disclose that the enhancement of uniformity of iodide content between silver halide grains can improve photographic properties of silver halide emulsions.

Moreover, patent applications that focus uniformity of microscopic distribution of iodide in a silver halide grain have also been published.

WO89/06830 discloses a technique relating to silver halide grains having a silver iodobromide phase the halogen composition of which is so uniform that no fluctuation or no ununiformity of halogen composition can be detected by observation using a transmission electron microscope. JP-A-11-125874 discloses that making the variation coefficient of intergrain iodide distribution in portions near grain surfaces to be 45% or less can improve photographic properties such as sensitivity.

The known patent applications and so on relating to the uniformity of iodide distribution between or in silver halide grains, however, investigate no silver halide emulsion comprising thin tabular grains having a thickness of 0.1 $\mu$m or less.

As described above, it is true that the reduction of grain thickness results in the increase of surface area per unit volume to enhance photoabsorption.

However, in the region where the grain thickness is 0.1 $\mu$m or less, there is a fact that no enhancement occurs in sensitivity/graininess ratio corresponding to the increase of photoabsorption. This fact occurs more notably in the case where a main plane has an equivalent-circle diameter of 3.0 $\mu$m or more. Only insufficient investigation has been made for silver halide tabular grains having a grain thickness of 0.1 $\mu$m or less about what type of uniformity of intergrain or intragrain iodide distribution is desirable. There are expectations for further increase in sensitivity/graininess ratio of silver halide emulsions through the development of technologies focusing on the aforementioned point.

BRIEF SUMMARY OF THE INVENTION

It is an object of the present invention to increase the sensitivity/graininess ratio of emulsions comprising silver halide tabular grains through providing emulsions comprising silver halide tabular grains having uniformity of intergrain and intragrain iodide distributions suitable for the cases where the grain thickness is 0.1 $\mu$m or less. Another object of the present invention is to reduce the change of photographic properties occurring when a pressure is applied. Still another object of the present invention is to provide silver halide emulsions having higher sensitivities by the above means.

After the intensive investigations by the inventors of the present invention, the objects of the present invention have attained using the following silver halide emulsions and silver halide light-sensitive materials:

(1) A silver halide emulsion comprising silver halide grains, wherein the variation coefficient of equivalent-circle diameters of all the silver halide grains is 40% or less, and 70% or more of the total projected area of all the grains is accounted for by silver halide grains each satisfying the following requirements (i), (ii) and (iii):

(i) a silver iodobromide or silver iodochlorobromide tabular grain having (111) planes as main planes thereof, (ii) a thickness thereof is 0.1 μm or less, and (iii) surface iodide contents in the main plain thereof meeting the following relations:

$$Io<30 \text{ mol \% and}$$

$$0.7Io<Is<1.3Io$$

wherein "Is" is an average value of surface iodide contents (Ip's) in the main plane of each grain and "Io" is an average value of the "Is" values of all the tabular grains;

(2) The silver halide emulsion recited in item (1) above, wherein each of the silver halide tabular grains accounting for 70% or more of the total projected area further satisfying requirement (iv) below:

(iv) the equivalent-circle diameter is 1.0 μm or more, and the variation coefficient of the distribution of the surface iodide contents (Ip's) in one silver halide grain is 30% or less, wherein the surface iodide content being measured in every measurement area all over the main plane of the silver halide grain and the measurement area being a square having a side length of 100 nm;

(3) The silver halide emulsion recited in item (1) or (2) above, wherein in the requirement (iii) above, the average value of surface iodide contents in the main plane of each grain represented by "Is" satisfies the relation: $0.8Io<Is<1.2Io$;

(4) The silver halide emulsion recited in item (2) or (3) above, wherein in the requirement (iv) above, the variation coefficient of the surface iodide contents in a silver halide grain represented by "Ip's" is 20% or less;

(5) The silver halide emulsion recited in item (1), wherein each of the silver halide tabular grains accounting for 70% or more of the total projected area further satisfying requirement (iv') below:

(iv') the equivalent-circle diameter is 3.0 μm or more;

(6) The silver halide emulsion recited in any one of items (2) to (4) above, wherein in the requirement (iv) above, the equivalent-circle diameter is 3.0 μm or more;

(7) The silver halide emulsion recited in any one of items (1) to (6) above, wherein when the emulsion is irradiated with an electromagnetic wave of 325 nm under the environment of an absolute temperature of 6° K., induced fluorescence of 575 nm with an intensity of at least one third the intensity of the maximum fluorescent emission induced in the wavelength range of from 490 to 560 nm, is emitted;

(8) The silver halide emulsion recited in any one of items (1) to (7) above, wherein each of the silver halide tabular grains accounting for 70% or more of the total projected area further satisfying requirement (v) below:

(v) when the distribution of iodide contents is measured on an imaginary plane inside the tabular grain which is parallel to the main plane and which is present in the depth of 20% of the tabular grain thickness from the main plane, the measurement points at which the iodide content is maximum distribute in the form of a circle surrounding the center of the imaginary plane, wherein the iodide content being measured in every measurement area all over the imaginary plane and the measurement area being a square having a side length of 100 nm;

(9) The silver halide emulsion recited in item (8) above, wherein the iodide contents at the measurement points at which the iodide contents are maximum are within the range of from 15 mol % to 40 mol %;

(10) The silver halide emulsion recited in any one of items (1) to (9) above, wherein each of the silver halide tabular grains accounting for 70% or more of the total projected area further having 10 or more dislocation lines per grain at the peripheral portion thereof; and

(11) A silver halide photographic light-sensitive material, wherein a light-sensitive emulsion layer contains the silver halide emulsion recited in any one of items (1) to (10) above.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below. The present invention concerns emulsions comprising silver iodobromide or silver iodochlorobromide tabular grains. First, characteristics of the emulsions of the present invention are described.

In the present invention, a tabular grain refers to a silver halide grain having two opposing, parallel (111) main planes. Each of the tabular grains used in the present invention has at least one twin plane and preferably has two parallel twin planes. The term "twin plane" refers to a (111) plane on the two sides of which ions at all lattice points have a mirror image relationship. It is possible to adjust the distance between the two twin planes to less than 0.012 μm as described in U.S. Pat. No. 5,219,720. Moreover, it is also possible to adjust the quotient of the distance between (111) main planes divided by the distance between twin planes to 15 or more as described in JP-A-5-249585.

Tabular grains with a grain thickness of 0.1 μm or less account for 70% or more of the total projected area of the grains contained in an emulsion of the present invention. The projected area of an individual tabular grain (in the present invention, the diameter of a circle having the same area as this projected area is referred to as an equivalent-circle diameter of a main plane), the grain thickness and the aspect ratio can be determined from an electron micrograph according to the technique of carbon replica shadowed together with spherical latex particles for reference. The equivalent spherical diameter indicates the diameter of a sphere having the same volume as that of the tabular grain calculated from the above projected area and the grain thickness. The tabular grain, when viewed from a point perpendicular to the main plane, generally has a hexagonal, triangular or circular shape, and the aspect ratio is the quotient of the diameter of a circle having the same area as the projected area of a grain (that is, the equivalent-circle diameter of a main plane) divided by the thickness thereof. The tabular grains accounting for 70% or more of the total projected area preferably have an aspect ratio of 7 or more, more preferably 10 or more. The higher the ratio of the main planes having a hexagonal shape, the more desirable for the emulsions of the present invention. Tabular grains having a hexagonal main plane whose ratio of the maximum side length thereof to the minimum side length thereof is from 2 to 1 account for preferably 70% or more, more preferably 90% or more of the total projected area of the grains. Still more preferably, tabular grains having a hexagonal main plane whose ratio of the maximum side length thereof to the minimum side length thereof is from 1.5 to 1 account for 90% or more of the total projected area of the grains.

In the emulsions of the present invention, the variation coefficient of the equivalent-circle diameter distribution of the main planes of the tabular grains is 40% or less and preferably 25% or less. The variation coefficient of equivalent-circle diameters means the quotient of the standard deviation of the distribution of the equivalent-circle diameters of individual silver halide grains divided by the average equivalent-circle diameter.

The emulsions of the present invention comprise silver iodobromide or silver iodochlorobromide. The halogen compositions thereof may contain chlorine, but the chlorine content is desirably 8 mol % or less, more desirably 3 mol % or less, or 0 mol %. With respect to the iodide content, both the variation coefficient of equivalent spherical diameters of the grains and that of equivalent-circle diameters of the main planes are 25% or less. From this viewpoint, therefore, the iodide content is preferably 20 mol % or less. Further, the iodide content is preferably 14 mol % or less, more preferably 8 mol % or less. The reduction of iodide content renders it easy to reduce the grain thickness of tabular grains and to reduce the variation coefficients of equivalent spherical diameters the tabular grains and that of equivalent-circle diameters of the main planes.

The emulsions of the present invention have the primary characteristic that they comprise silver halide tabular grains with high uniformities of intergrain and intragrain distributions of the surface iodide contents in main planes. With respect to the "uniformity of intergrain iodide distribution," discussed in most conventional cases was whether the values of average iodide content of individual entire grains are uniform or varied between grains. Contrary to the present invention, no special attentions were paid to the uniformity of iodide content in specific sites of grains. With respect to the uniformity of intragrain iodide distribution, discussed in many cases was the uniformity surmised from the shading of an image obtained using a transmission electron microscope. There were almost no examples in which the uniformity is treated numerically like the variation coefficients discussed in the present invention. During the research for enhancing the sensitivity of thin tabular grains having a grain thickness of 0.1 μm or less up to the sensitivity expected from absorption efficiency, the inventors of the present invention found that if the grain thickness becomes 0.1 μm or less, the uniformities of intergrain and intragrain distributions of the surface iodide content in main planes are deteriorated. Further, they have found that the deterioration of such uniformities is a main cause of the deterioration of photographic properties. They have reached the present invention by applying measures to prevent the deterioration of such uniformities to thin tabular grains having a grain thickness of 0.1 μm or less.

In the emulsions of the present invention, regardless of the absolute value of the surface iodide content, the silver halide tabular grains having a variation coefficient of the surface iodide content distribution in main planes of 30% or less account for 70% or more of the total projected area of the grains. The above variation coefficient is preferably 20% or less. The reduction of this variation coefficient results in the effect of enhancing sensitivity and reducing the change in photographic properties caused by the application of pressure.

The average value of the surface iodide contents is required to be less than 30 mol %, because it is necessary to perform chemical sensitization after silver halide grain formation without trouble, and the average value preferably is 2 mol % or more and 8 mol % or less.

The "surface iodide content" referred to in the present invention indicates the iodide content in the region of from the outermost surface to the depth of 3 nm from the outermost surface. In the present invention, the surface iodide content can be detected by secondary ion mass spectrometry (SIMS). SIMS is an analysis method having a spatial resolution such that the distribution of the surface iodide content in main planes of silver halide tabular grains of the present invention can be measured.

The most desirable one of SIMS is the time-off-flight secondary ion mass spectrometry (TOF-SIMS). A description on TOF-SIMS is given concretely in "Surface Analyzing Technology Series, Secondary Ion Mass Spectrometry" edited by The Surface Science Society of Japan, published by Maruzen, Co., Ltd., 1999. In this technology, the surface iodide content in main planes of silver halide tabular grains is measured by concentrating the beam diameter of primary ions applied and scanning the concentrated beam to detect iodide present in every scanned site.

For example, when using a TOF-SIMS of TRIFT-II Model available from Phi Evans, it is possible to measure the distribution of the surface iodide content in one silver halide grain with a spatial resolution of about 100 nm. For silver halide tabular grains whose main planes have an equivalent-circle diameter of 1.0 μm or more, it is possible to estimate the uniformity of the distribution of the surface iodide contents in main planes of individual grains.

The surface iodide content in a main plane is measured reticulatedly for every 100 nm square in the main plane. Then, the values of iodide content at individual measurement points, i.e., Ip values, the average of the Ip values, i.e., Is, and the standard deviation of the Ip values are calculated. The variation coefficient (%) of Ip, which is calculated with the formula: {(Standard deviation of Ip)/Is}×100, is used as the standard for the evaluation of the uniformity of the distribution of the surface iodide content in the main plane of each grain. If the equivalent-circle diameter of a main plane is 1.0 μm or more, it is possible to secure at least 60 measurement points, so that the aforementioned evaluation can be done.

Since if the equivalent-circle diameter of a main plane is small, the number of measurement points is reduced and, therefore, it becomes difficult to evaluate the uniformity of the distribution of the surface iodide contents in main planes of individual grains. However, the average value, i.e., Is, of the surface iodide contents in the main planes of individual grains can be calculated through calculation of the average value of Ip values for each grain.

The Is of individual grains and the average thereof (Io) are calculated. A coefficient by which the value of Io is multiplied to give a region within which the Is of tabular grains accounting for 70% of the total projected area are can be used as the standard for the estimation of the intergrain distribution of the surface iodide contents in the main plane.

That is, the evaluation is conducted by using the Is values and a coefficient, α, by which the Io value is multiplied. More specifically, the evaluation is conducted by using the Is values of the tabular gains accounting for 70% of the total projected area and the value of αIo.

The above-mentioned evaluation is applied not only to the grains whose main plain has an equivalent-circle diameter of less than 1.0 μm but also grains whose main plain has an equivalent-circle diameter of 1.0 μm or more.

In the emulsions of the present invention, it is only required that each of the Is values of the tabular grains accounting for 70% or more of the total projected area satisfies the relation: $0.7Io<Is<1.3Io$. It is desirable that the relation: $0.8Io<Is<1.2Io$ is satisfied.

The estimation of the halogen distribution in the region extending from the outermost surface of a silver halide grain to the depth of 3 nm from the outermost surface is performed using TOF-SIMS under the following measurement conditions.

A specimen is used which is prepared by spraying an emulsion onto a conductive substrate so that no silver halide grains overlap.

$Ga^+$ ion is used as a primary ion. If the acceleration voltage of primary ions and the amount of electric current are adjusted to 25 kV and 60 pA or less, respectively, the halogen distribution can be measured with a spatial resolution of about 100 nm. SIMS is a destructive analysis and, therefore, the area irradiated with primary ions is naturally broken. For preventing the spread of damage outside of the area irradiated with primary ions, it is desirable to cool a specimen to a temperature of −120° C. or lower. One measurement is performed while a single grain is put in a visual field. The measurement of intragrain halogen distribution of a plurality of grains can be accomplished by the measurement repeated the times the same as the number of the grains to be measured, with change of the visual field.

The analysis depth corresponding to the region of a silver halide grain from its outermost surface to the depth of 3 nm from the outermost surface can be achieved by adjusting the irradiation time after adjusting the acceleration voltage of primary ions and the value of electric current to the aforementioned values, respectively. Specifically, using several silver halide grains each prepared by forming a silver halide layer on a huge silver bromide gain, with a variation of its halogen composition of the silver halide layer, prepared with reference to J. F. Hamilton, Phil, Mag., 16, 1 (1967), the measurement is preliminarily performed only for the centers of the individual grains under several measurement conditions. Based on the results of the above measurements, it is possible to determine a primary ion irradiation time corresponding to analysis depth of 3 nm by measuring the depths of the craters formed in the center portions of the grains with a use of an atomic force microscope (AFM).

Further, the measurement of halogen distribution in a plane that extends apart by a depth "d" from the main plane of a silver halide tabular grain and that is parallel to the main plane, is performed by repeating primary ion irradiation under the constant conditions while scanning the entire main plane of the silver halide tabular grain and, in a plane which appeared when the silver halide tabular grain had been etched to the depth "d," measuring a halogen distribution in the plane. The measurement can be performed in the same manner as the aforementioned measurement of halogen distribution in the main plane. The depth to which a silver halide grain has been etched can be estimated based on the depth of etching determined by the aforementioned AFM measurement and the value of the product, (primary ion irradiation time)×(the number of irradiations).

In the present invention, it is advantageous for achieving a high sensitivity and, therefore, is desirable that in a plane parallel to a main plane, present in a depth of 20% of the silver halide tabular grain thickness from the main plane, the measurement points at which the iodide content becomes maximum are distributed in the form of a circle surrounding the center of the plane. The center of a plane referred to in the present invention designates a point at which a figure defined by the border line of the plane is concentrated if the figure is reduced as small as possible while maintaining similarity. In the present invention, "measurement points at which the iodide content becomes maximum are distributed in the form of a circle surrounding the center of the plane" means that all the following conditions (a) through (c) are satisfied:

(a) when the change in the surface iodide content is measured outwardly from the center of the plane to the border line of the plane in all directions, all of the measurement points at which the iodide content becomes maximum are present far from the center at a distance of 55% or more of the distance between the center and the border line;

(b) when the ratio L/R is measured outwardly from the center for all directions, wherein L is the distance between the center and a measurement point at which the surface iodide content becomes maximum and R is the distance between the center and the border line of the plane, the difference between the maximum and minimum of the L/R values is 0.3 or less; and (c) when the maximum value of the surface iodide content is determined outwardly from the center for all directions, the variation coefficient of the maximum values is 30% or less.

However, it is very difficult to perform the measurement of (a) closely. This is because it is difficult to transmit a primary ion beam of TOF-SIMS on a target site and the beam diameter is so large that it can no more be disregarded as compared to the size of the plane. Therefore, in the present invention, the measurement of the surface iodide content distribution conducted first in the aforementioned manner for the whole plane and the subsequent plotting of the values of iodide content at the closest measurement point present on a segment between the center of the plane and the border line picked up from the vicinity of the center toward the border line are substituted for the measurement of (a) above.

It is desirable that the iodide content at a measurement point at which the aforementioned iodide content becomes maximum is 15 mol % or more and 40 mol % or less.

In the present invention, a TOF-SIMS to be used for the measurement desirably has a multichannel detection system capable of simultaneously measuring two or more of the various kinds of secondary ions emitted from sites broken by primary ions. Further, the TOF-SIMS to be used must have a function of indicating the location of the measurement point in the measured silver halide tabular grain and the measured value corresponding to the measurement point.

In order to prepare a specimen for TOF-SIMS measurement from a silver halide emulsion to be used for the measurement, there is a necessity of decomposing gelatin, which is a dispersion medium of the silver halide emulsion, with a protein-decomposing enzyme such as actinase and separating the silver halide grains through removal of the supernatant by centrifugation and washing with pure water. It is possible to separate silver halide grains by decomposing a gelatin in a binder with a protein-decomposing enzyme and performing centrifugation and washing in the same manner as described above also in the case where the grains are present in a coating film of a light-sensitive material.

When a sensitizing dye is adsorbed to silver halide grains, the sensitizing dye can be removed by use of an alcohol such as methanol or an alkaline aqueous solution.

The silver halide grains separated are dispersed in water, applied to a conductive substrate, dried, and then used for measurement. As the conductive substrate, those having a smooth surface, containing, in an amount reduced as much as possible, elements easy to give disturbance to the measurement of alkali metal and so on, and being clean are suitable. Concretely, it is desirable to use products obtained by washing mirror-finished single-crystal silicon wafers, such as those employed for the preparation of semiconductor devices, fully with organic solvents, strong acids, pure water or the like.

In the emulsions of the present invention, the variation coefficient of the intergrain distribution of the average iodide content of the whole grain of each silver halide grain is desirably 20% or less, more desirably 15% or less and especially desirably 10% or less regardless of the absolute value of the average iodide content of the whole silver halide grains.

The iodide content of the whole grain of each silver halide grain can be measured using EPMA (also called XMA). EPMA is a technology where a sample in which silver halide grains are well dispersed so as not to come in contact with each other and X-rays resulting from the stimulation of the silver halide grains with electrons transmitted with an electron beam are analyzed. By EPMA can be performed elemental analysis of the silver halide grains to be measured. Depending on the difference in measuring method, the EPMA technology is classified into TEM (transmission type) and SEM (scanning type), each of which is further classified into WDS (wavelength dispersion type) and EDS (energy dispersion type). If the intensities of the characteristic X-rays of silver and iodide emitted from silver halide grains irradiated with an electron beam are determined using the EPMA technology, the iodide content in the silver halide grains can be measured. The variation coefficient of intergrain iodide content distribution is a value defined by a relation: (standard deviation/average iodide content)×100= variation coefficient, using the standard deviation of iodide contents and the average iodide content obtained through the measurement of iodide content for at least 60, preferably 150 or more, especially preferably 300 or more of emulsion grains. The measurement of the iodide contents of individual grains is described in, for example, EP No. 147,868. In some cases there is a correlation and in other some cases there is not any correlation between the iodide content Yi (mol %) and the equivalent-circle diameter Xi ($\mu$m) of each grain. It is desirable that they are not correlated.

An EPMA device to be used may be any type previously described. However, the diameter of an electron beam transmitted must be adjusted to not larger than a diameter necessary for distinguishing individual grains. Further, the measurement temperature must be adjusted to −120° C. or lower for preventing, as much as possible, the damage of a specimen caused by the transmission of electron beam. The integration time at each measurement point must be 30 seconds or more.

For the structure concerning the silver halide composition of tabular grains contained in the emulsions according to the present invention, the average halogen composition in the surfaces of silver halide grains and what halogen composition forms a phase inside silver halide grains may be investigated by using XPS or X-ray diffraction in addition to TOF-SIMS and EPMA mentioned above.

For the iodide distribution in silver halide tabular grains contained in the emulsions of the present invention, it is desirable that there is at least one phase having a high iodide content inside a grain and the iodide distribution has a structure inside the grain as described above. In such a case, the structure of iodide distribution may be a double, triple, quadruple, quintuple, or more multiple structures.

There may be a region where the iodide content changes rapidly and, alternatively, the change of iodide content may be gradual in all portions. For introducing a dislocation line, it is often preferable that there is a region where the iodide content changes with some or more rapidity.

In the present invention, it is preferable that at least one phase having a high iodide content present in a silver halide grain has a characteristic that induced fluorescence near 575 nm is emitted when the silver halide grain is irradiated with an electromagnetic wave of 325 nm (for example, He—Cd laser beam) under the environment where the grain is cooled to an absolute temperature of less than 10° K (in this specification, 6° K is chosen for concrete comparison).

Usually, when an electromagnetic wave of 325 nm is transmitted under the environment where a silver halide grain having a phase with a high iodide content is cooled to an absolute temperature of less than 10° K., a single induced fluorescence peak is observed in the wavelength range of from 490 to 560 nm. Although an exact wavelength of the maximum fluorescence may vary depending on the level of iodide content, the profiles of the fluorescent curves are the same. In this case, it is indicated that the iodide ions present in the phase with a high iodide content are almost completely contained in a silver bromide crystal lattice structure.

On the other hand, if part of the iodide ions present in a phase with a high iodide content are not contained in a silver bromide crystal lattice structure and the phase with a high iodide content has a defect or deformation in its crystal lattice, an induced fluorescence near 575 nm is emitted in addition to the induced fluorescence within the wavelength range of from 490 to 560 nm.

In silver halide grains of the emulsions of the present invention, it is preferable that when silver halide grains are irradiated with an electromagnetic wave of 325 nm under the environment of an absolute temperature of 6° K., induced fluorescence of 575 nm with an intensity of at least one third the intensity of the maximum fluorescent emission induced in the wavelength range of from 490 to 560 nm is emitted.

The tabular gains of the emulsion of the present invention preferably have a dislocation line. The dislocation line in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to an electron beam. In this case, as the thickness of a grain is increased, it becomes more difficult to transmit an electron beam through it. Therefore, grains can be observed more clearly by using an electron microscope of a high voltage type (200 kV or more for a grain having a thickness of 0.25 $\mu$m). From the photograph obtained by these methods, the position and number of the dislocation line in each grain in the case where the grain was viewed from a position perpendicular to the main plane, can be obtained.

The dislocation lines are preferably introduced into the tabular grains of the emulsion of the present invention at the peripheral portion thereof. The dislocation lines at the peripheral portion are almost perpendicular to the periphery, and usually arise from the position of x % of the distance between the center of the tabular grain to the border line (periphery), toward the periphery. The value of x is 55 or more and less than 99, preferably 70 or more and less than 98. In this case the shape formed by connecting the starting position of the dislocation lines has closely similar figure to the tabular grain. However, the shape sometimes does not have the similar figure, but distorted. The dislocation lines of this type do not appear in the central area of the grain.

The directions of the dislocation lines are crystallographically almost in the (211) direction, but the dislocation lines often windle or sometimes cross to each other.

In tabular grains contained in the emulsions of the present invention, it is preferable that a dislocation line is introduced to a peripheral portion of the silver halide grains accounting for 70% or more of the total projected area. The number of dislocation lines present in a peripheral portion is preferably 10 ore more per grain and more preferably 20 or more per grain. The "peripheral portion of a grain" herein referred to designates a region where the aforementioned x is 75 or more and 100 or less. It is to be noted that not the entire length of each dislocation line must be within that region.

Further, although dislocation lines can be present almost uniformly across the entire peripheral portion of a tabular grain or may be localized in the vicinities of corners of the grain, it is often preferable that a tabular grain has dislocation lines throughout its peripheral portion. In a tabular grain having triangular or hexagonal outer surfaces, when perpendicular lines are extended from a position which is at 75% from the center of this tabular grain on a straight line between the center of the tabular grain and each corner to two edges forming this corner, the vicinity of the corner means a portion surrounded by these perpendicular lines and the two edges, i.e., the portion being a three-dimensional region across the entire thickness of the grain.

When a tabular grain is rounded, each corner is unclear. Even in a tabular grain like this, it is possible to obtain three or six tangents with respect to the peripheral portion and then obtain, as corners, points where straight lines connecting the intersections of these tangents to the center of the tabular grain intersect the circumference of the tabular grain.

If dislocation lines are densely present or they are observed to cross each other, it is sometimes impossible to correctly count dislocation lines per grain. Even in these situations, however, dislocation lines can be roughly counted on the order of, for example, 10 or 20 dislocation lines, thereby making it possible to distinguish these grains from those in which only less than 10 dislocation lines are present. The average number of dislocation lines per grain is obtained as a number average by counting dislocation lines for 100 or more grains.

Next, an emulsion preparation step in the present invention is described.

A step of forming grains of a silver halide tabular grain emulsion comprises basically three steps, nucleation, ripening, and growth. In the step of nucleation, to use a gelatin having a small methionine content disclosed in U.S. Pat. Nos. 4,713,320 and 4,942,120, to perform the nucleation at a high pBr disclosed in U.S. Pat. No. 4,914,014, and to perform the nucleation in a short time disclosed in JP-A-2-222940 are very effective for the nucleation step of the emulsions of the present invention comprising silver halide tabular grains. In the ripening step, to perform the ripening in the presence of a base of a low concentration disclosed in U.S. Pat. No. 5,254,453 and to perform the ripening at a high pH disclosed in U.S. Pat. No. 5,013,641 may be effective for the ripening step of the emulsions of the present invention.

In the growth step, to perform the growth at low temperature disclosed in U.S. Pat. No. 5,248,587 and to use silver iodide fine grains disclosed in U.S. Pat. Nos. 4,672,027 and 4,693,964 are especially effective for the growth step of the emulsions of the present invention. Further, an approach in which the growth is performed by adding fine grain emulsions of silver bromide, silver iodobromide and silver iodochlorobromide and ripening is also desirably employed. It is also possible to supply the aforementioned fine grain emulsions using an agitation device disclosed in JP-A-10-43570.

To obtain high-aspect-ratio monodisperse tabular grains, gelatin is sometimes added during grain formation. The gelatin used for the purpose is preferably chemically modified gelatin described in JP-A's-10-148897 and 11-143002 or gelatin having a small methionine content described in U.S. Pat. Nos. 4,713,320 and 4,942,120. The former chemically modified gelatin is a gelatin characterized in that at least two carboxyl groups are newly introduced when an amino group in gelatin is chemically modified. It is preferable to use succinated gelatin or trimellitated gelatin. This chemically modified gelatin is added preferably before the growth step. The addition amount thereof is 50% or more, preferably 70% or more of the weight of a total dispersing medium during grain formation.

In the emulsions of the present invention, the step of growth of tabular grains preferably has a step of forming a high iodide content phase having an iodide content of 15 mol % or more and 40 mol % or less, performed during the growth step. This additional step is a step that is performed in order to cause tabular grains to have an iodide distribution such as that previously described or to introduce dislocation lines. This step causes the improvement in sensitivity and pressure characteristic. This step is described below.

The aforementioned high iodide content phase may be provided either by forming a phase having an iodide content, which is measured by TOF-SIMS, of 15 mol % or more and 40 mol % or less, directly on a silver halide tabular grain serving as a host or by forming a silver iodide phase or a phase containing iodide of 40 mol % or more first and then causing recrystallization between the previously formed phase and a phase having a low iodide content.

The concrete method for forming the high iodide content phase may be any method such as a method in which an aqueous solution containing iodide ions such as an aqueous potassium iodide solution is added to an emulsion comprising silver halide tabular grains serving as a host, a method in which an aqueous solution containing iodide ions described above and an aqueous solution containing silver ions such as an aqueous silver nitrate are added using the double jet method, a method in which an iodide ion-releasing agent such as that described in JP-A-2-68538 is used, and a method in which a sparingly soluble silver halide emulsion typified by a silver iodide fine grain emulsion described in JP-A-1-183417 and so on is added.

However, among these methods, the method in which an iodide ion-releasing agent is used and the method in which a sparingly soluble silver halide emulsion is added are advantageous and preferable due to the fact that the variance of silver iodide content in a main plane of a tabular grain or between grains can be reduced.

Most preferably, the above-mentioned high iodide content phase is formed by forming fine grains of silver iodide or silver iodobromide by mixing a water-soluble silver salt and a water-soluble halide in a mixing vessel different from a reaction vessel containing an emulsion comprising silver halide tabular grains serving as a host under the growth step, and supplying the fine grains, immediately after their formation, to the reaction vessel containing the emulsion comprising silver halide tabular grains serving as a host.

According to the investigation result obtained by the inventors of the present invention, the induced fluorescence emitted near 575 nm when an electromagnetic wave of 325 nm is transmitted under the environment where the aforementioned silver halide grain is cooled to an absolute temperature of less than 10° K. became most intense and, corresponding to this, the photographic properties were also most desirable.

In the case where the aforementioned high iodide content phase is formed by the method using an iodide ion-releasing agent, it is desirable to release iodide ions with an iodide ion-releasing agent under the conditions where solubilities of a silver halide tabular grain serving as a host and iodide-containing phases precipitated on the grain are low and iodide precipitates selectively on a peripheral portion of the tabular grain. Concretely, it is preferable to adjust the temperature during the release of iodide ions to from 28° C. to 45° C. and pAg to from 8.0 to 10.5.

Especially with respect to the temperature, if the temperature is too high, a portion where specifically many high iodide content phases are present easily appears. In such an occasion, the uniformity in iodide distribution in main planes of the silver halide tabular grains after growth may be deteriorated. If iodide ions are released under the aforementioned desirable conditions about temperature and pAg, iodide-containing phases containing substantially more than 40 mol % of silver iodide are precipitated in peripheral portions of the tabular grains. If silver bromide, or silver iodobromide and silver chloroiodobromide having a small iodide content are precipitated outside the iodide-containing phases, recrystallization occurs between the iodide-containing phases and, as a result, high iodide content phases having an iodide content of from 15 mol % to 40 mol %, can be formed.

The high iodide content phases are formed so as to completely cover the surface of the silver halide tabular grains serving as a host, but the iodide distribution tends to be concentrated in a region surrounding the side face of a silver halide tabular grain serving as a host, and especially tends to be concentrated in the vicinities of corners.

If the amount of the iodide ion-releasing agent is sufficient and the silver amount ratio in high iodide content phases is sufficient, the high iodide content phases are distributed so as to surround the side face of a silver halide tabular grain without leaving space. If the amount of the iodide ion-releasing agent is insufficient and the silver amount ratio in high iodide content phases is insufficient, it sometimes is impossible to surround the side face of a silver halide tabular grain without leaving space.

In the former case, with respect to the iodide distribution in a plane parallel to a main plane, present in a depth of 20% of the silver halide tabular grain thickness from the main plane, the high iodide content phases are present in the form of a circle surrounding the center of the plane. However, in the latter case, spaces containing no high iodide content phases are formed and the distribution of the high iodide content phases does not become circular.

If the amount of the iodide ion-releasing agent is excessive and the silver amount ratio in high iodide content phases is excessive, a portion where specifically many high iodide content phases are present may appear. In such an occasion, the uniformity in iodide distribution in main planes of the silver halide tabular grains after growth may be deteriorated. Therefore, there is a necessity of using the iodide ion-releasing agent in an amount within an appropriate range. This appropriate range is approximately within the range of from 0.7 to 7 mol % based on the silver amount of the whole silver halide tabular grains, but the range varies depending on the size of silver halide tabular grains serving as a host, the thickness of a shell portion that will be formed after the formation of the high iodide content phases, and so on. The appropriate amount of the iodide ion-releasing agent, therefore, must be determined by preparing samples having different amounts of iodide ion-releasing agent depending on the preparation conditions of individual emulsions and comparing the aforementioned iodide distribution.

Iodide ion-releasing agents which can be employed suitably for the present invention include those described in JP-A's-2-68538 and 11-295836. Specific examples thereof include, but are not limited to, those described above.

(1) $ICH_2COOH$ (2) $ICH_2CONH_2$ (3) $ICH_2CN$ (4) $I(CH_2)_2COOH$ (5) $I(CH_2)_3COOH$ (6)

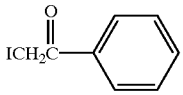

(7)

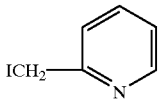

(8)

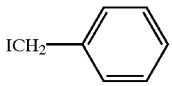

(9) $I(CH_2)_2SO_3Na$

(10) $I(CH_2)_2SO_3CH_3$

(11) $I(CH_2)_2OH$

(12) $I(CH_2)_3OH$

(13) $I(CH_2)_4OH$

(14) $ICH_2CHOH$ | $CH_3$

(15) $ICH_2CHOH$

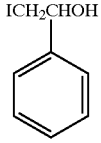

(16) $ICH_2CHCH_2OH$ | OH

(17) $ICH_2CHCH_2SO_3Na$ | OH (18)

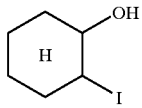

-continued
(19)
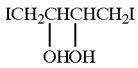
(20)
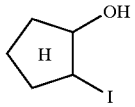
(21)
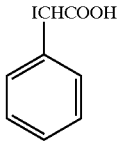
(22) $I(CH_2)_2SO_2CH_2CONH_2$
(23) $I(CH_2)_2NH_2$
(24) $I(CH_2)_2NHSO_2CH_3$
(25) $I(CH_2)_2NHCOCH_3$
(26) $I(CH_2)_2OCH_3$
(27) $I(CH_2)_2SCH_3$
(28)
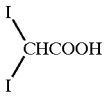
(29)
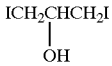
(30) $I(CH_2)_2SO_2NH_2$
(31)
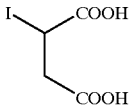
(32)
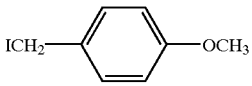
(33)
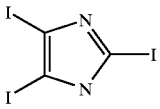
(34)
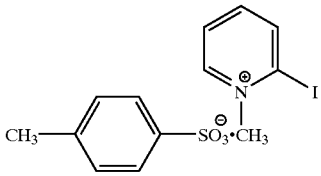
(35)
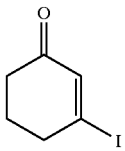
-continued
(36)
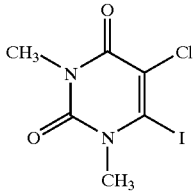
(37)
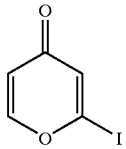
(38)
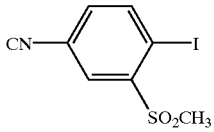
(39)
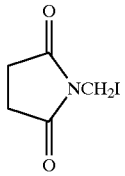
(40)
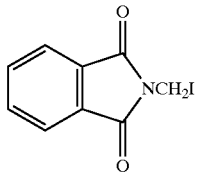
(41)
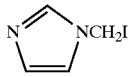
(42)
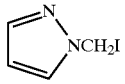
(43)
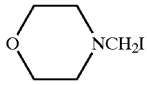
(44)
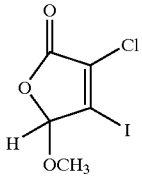
(45)
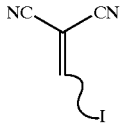
(46)
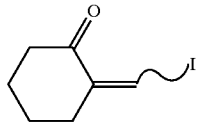

-continued

(47) $I(CH_2)_5COOH$ (48)

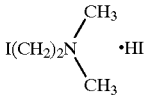

(49) $I(CH_2)_2N(CH_3)SO_2CH_3$

(50) $I(CH_2)_2OCOCH_3$

(51) $I(CH_2)_2N(CH_3)COCH_3$ (52)

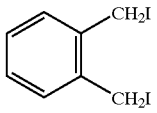

(53)

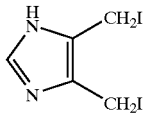

(54)

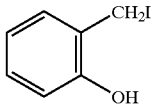

(55)

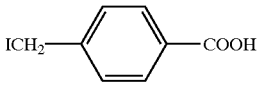

(56)

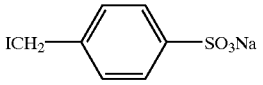

(57) $ICH_2CONH(CH_2)_2—SO_3Na$ (58)

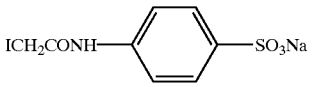

(59)

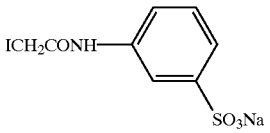

(60)

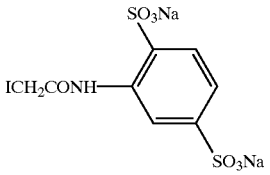

(61)

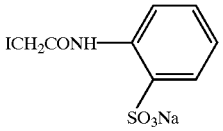

(62)

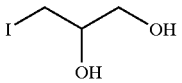

-continued (63)

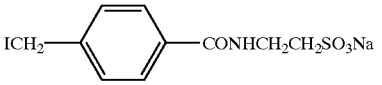

(64)

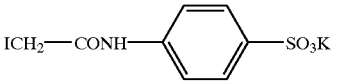

(65)

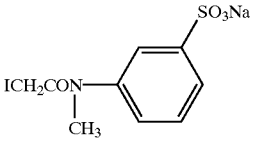

(66)

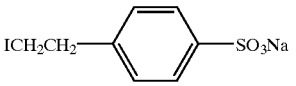

(67)

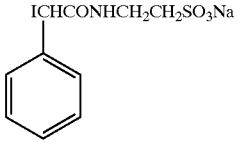

(68)

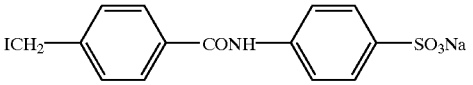

(69)

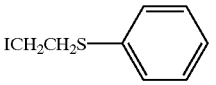

These compounds release iodide ions when they are allowed to react with nucleophilic compounds such as sodium sulfite in the atmosphere of pH 7 to 10. When causing an iodide ion-releasing agent to release an iodide ion, it is desirable to take an addition sequence such as adding the iodide ion-releasing agent to an emulsion comprising silver halide tabular grains serving as a host, stirring the mixture until the agent is dispersed uniformly, then adjusting pH, and thereafter adding a nucleophilic compound.

On the other hand, in the case where the aforementioned high iodide content phase is formed by the method comprising adding a sparingly soluble silver halide emulsion, it is desirable to form the high iodide content phase under the conditions where solubilities of a silver halide tabular grain serving as a host and an iodide-containing phase precipitated on the grain are low. Concretely, it is preferable to adjust the temperature to from 35° C. to 55° C. and pAg to from 8.0 to 10.5.

The sparingly soluble silver halide emulsion to be added is an emulsion comprising fine grains of silver iodide or silver iodobromide and preferably is an emulsion comprising silver iodide fine grains. The size of these fine grains is preferably 20 nm or less, and more preferably 10 nm or less. Further, the variation coefficient of grain size distribution of the fine grains is preferably 20% or less.

As a concrete method for forming the high iodide content phase, this phase is formed by forming fine grains of silver iodide or silver iodobromide by mixing a water-soluble silver salt and a water-soluble halide in a mixing vessel different from a reaction vessel containing an emulsion comprising silver halide tabular grains serving as a host under the growth step, and supplying the fine grains, immediately after their formation, to the reaction vessel containing the emulsion comprising silver halide tabular grains serving as a host. Further, it is preferable to supply a water-soluble silver salt and a water-soluble halide by the double jet method to a reaction vessel containing an emulsion comprising silver halide tabular grains serving as a host simultaneously with the supply of the aforementioned fine grains. One of preferable examples is a method in which the aforementioned high iodide content phase is formed by the addition of the silver iodide fine grains formed in the above mixing device, an aqueous silver nitrate solution and an aqueous potassium bromide solution.

To supply a water-soluble silver salt and a water-soluble halide simultaneously with the supply of the aforementioned fine grains does not necessarily mean that the timings of the starting/finishing of supplying the fine grains completely agree with the timings of the starting/finishing of supplying the water-soluble silver salt and the water-soluble halide. It has a meaning that there is a period when the supply of the fine grains to the reaction vessel overlaps the supply of the water-soluble silver salt and the water-soluble halide. It is preferable to commence to supply the fine grains first and, after about 1 to 30 seconds, commence to supply the water-soluble silver salt and the water-soluble halide. Further, it is preferable to finish the supply of the water-soluble silver salt and the water-soluble halide after finishing the supply of the fine grains. The gap between the finish of the supply of the fine grains and the finish of the supply of the water-soluble silver salt and the water-soluble halide is desirably from 10 seconds to about 5 minutes.

It is sometimes preferable to supply only the water-soluble silver salt simultaneously with supplying the fine grains. In this case, care must be taken that the amounts of the silver ions and the halide ions in the reaction vessel are balanced and the silver ions are not excessively present.

As for the aforementioned structure of a mixing device used for forming fine grains of silver iodide or silver iodobromide, preferred is one having at least one supply port for supplying a water-soluble silver salt to a sealed stirring bath therethrough, at least one supply port for supplying a water-soluble halide to the same bath therethrough and at least one exhaustion port for exhausting the formed fine grains of silver iodide or silver iodobromide therethrough and further having two stirring blades rotated in opposite directions in the sealed stirring bath, the stirring blades being magnetically coupled with external magnets placed outside the nearby bath walls, and the stirring blades being rotated with rotation drivers connected to the external magnets. A specific example of such a mixing device is disclosed in JP-A-10-239787.

By use of the above-mentioned mixing device, it is possible to reduce the size of fine grains to be formed very much. In the case of silver iodide fine grains, it is possible to produce fine grains having an average equivalent-circle diameter of 10 nm or less. By making the size of fine grains very small, it becomes easy to grow tabular grains having a small grain thickness or tabular grains having a small grain size.

One of the important factors for making the size of fine grains small is the time during which the addition solution of water-soluble silver salt and water-soluble halide to be introduced to the mixing device stays in a mixing space formed in the mixing device. The time t during which the addition solution stays in the mixing space of a mixing device in the present invention is expressed by the following formula:

$$t=v/(a+b+c)$$

v: Volume of a mixing space in the mixing device
a: Addition flow rate of a water-soluble silver salt solution
b: Addition flow rate of a water-soluble halide solution
c: Addition flow rate of a dispersion medium solution In the above formula, the addition flow rate of a dispersion medium solution represented by c is an addition flow rate of a dispersion medium solution required for the fine grains formed in the mixing device being present as a stable colloid without flocculation. A long staying time is unfavorable because the fine grains formed in the mixing device grow to have a large size and the size distribution becomes broad if the staying time is too long.

The value of t is 10 seconds or less, preferably 2 seconds or less, and more preferably 1 second or less.

As the dispersion medium, gelatin is usually employed. Especially, low-molecular-weight gelatin having an average molecular weight of from 1,000 to 80,000 is preferably used.

The dispersion medium solution to be added to the mixing device may be added alone to the mixing device or may be added in a state of being preliminarily mixed with a water-soluble halide solution. Although it is also possible to add the dispersion medium solution in a state of being preliminarily mixed with a water-soluble silver salt solution, it is difficult to handle because of a characteristic that a silver ion and a gelatin react to form a silver colloid.

The concentration of the dispersing medium contained in a dispersion medium solution or a water-soluble halide or water-soluble silver salt solution containing the dispersion medium to be added to the mixing device is preferably 1% or more and 20% or less.

Under the above preferable conditions, high iodide content phases having an iodide content of from 15 mol % to 40 mol %, can be formed on silver halide tabular grains serving as hosts. The high iodide content phases are formed so as to cover across the surface of the silver halide tabular grains serving as hosts. If the outermost portion of the surface of a silver halide tabular grain serving as a host is formed under a relatively low pAg such as from 6.3 to 8.3, it is sometimes desirable because it is possible to distribute much iodide in a region surrounding the side face of the silver halide tabular grain serving as a host.

If the amount of the silver iodide fine grains or silver iodobromide fine grains to be added is sufficient and the silver amount ratio in high iodide content phases is sufficient, the high iodide content phases can surround the side faces of a silver halide tabular grain without leaving space. If the amount of the silver iodide fine grains or silver iodobromide fine grains to be added is insufficient and the silver amount ratio in high iodide content phases is insufficient, it sometimes is impossible to surround the side faces of a silver halide tabular grain without leaving space.

In the former case, with respect to the iodide distribution in an imaginary plane parallel to a main plane, present in a depth of 20% of the silver halide tabular grain thickness from the main plane, the high iodide content phases are present in the form of a circle surrounding the center of the imaginary plane. However, in the latter case, spaces containing no high iodide content phases are formed and the distribution of the high iodide content phases does not become circular.

If the amount of the silver iodide fine grains or silver iodobromide fine grains is excessive and the silver amount ratio in high iodide content phases is excessive, a portion where specifically many high iodide content phases are present may appear. In such an occasion, the uniformity in iodide distribution in main planes of the silver halide tabular grains after growth may be deteriorated. Therefore, there is a necessity of using the silver iodide fine grains or silver iodobromide fine grains in an amount within an appropriate range. This appropriate range is approximately within the range of from 0.7 to 7 mol % based on the silver amount of the whole silver halide tabular grains, but the range varies depending on the size of silver halide tabular grains serving as a host, the thickness of a shell portion that will be formed after the formation of the high iodide content phases, and so on. The appropriate amount of the silver iodide fine grains or silver iodobromide fine grains, therefore, must be determined by preparing samples having different amounts of silver iodide fine grains or silver iodobromide fine grains depending on the preparation conditions of individual emulsions and comparing the aforementioned iodide distribution.

In the present invention, as a method for introducing dislocation lines to silver halide tabular grains, methods the same as those used for the formation of high iodide content phases previously described can be employed. Effective ways for introducing dislocation lines include making a large difference between the iodide content in a high iodide content phase and that in the phase adjacent to the high iodide content phase or adjusting the silver amount ratio of the high iodide content phase to an appropriate value.

Growth after the formation of the high iodide content phase is preferably achieved by the growth of silver bromide. When allowing silver iodobromide to grow, the iodide content is preferably 3 mol % or less based on the layer that is grown after the formation of the high iodide content phase. The silver amount ratio of this layer is preferably 5 or more and 50 or less and most preferably 10 or more and 35 or less, provided that the total silver amount of the completed tabular grain emulsion is 100. Although the temperature and pBr for the formation of this layer are not particularly limited, the employed temperature is usually 30° C. or more and 85° C. or less, preferably 35° C. or more and 70° C. or less, and more preferably 40° C. or more and 55° C. or less. pAg is preferably 6.5 or more and 10 or less, and more preferably 7.5 or more and 9 or less.

In the emulsions of the present invention, forming a positive hole-capturing zone in at least a part of the inside of a silver halide tabular grain is particularly effective for improvement in sensitivity/graininess ratio. A positive hole-capturing zone indicates a region having a function of capturing positive holes, e.g., positive holes in pairs with photoelectrons generated by photo-excitation. Methods for forming such a positive hole-capturing zone include a method in which a dopant is used. However, in the present invention, the positive hole-capturing zone is preferably formed by intentional reduction sensitization.

The "intentional reduction sensitization" for the emulsion of the present invention means the procedure in which positive hole-capturing silver nuclei are introduced into a part of the silver halide grain or the whole silver halide grain by the addition of a reduction sensitizer. The positive hole-capturing silver nuclei mean small nuclei having low developing activity, by which recombination loss in the exposure process is prevented thereby sensitivity is enhanced.

As the reduction sensitizer, stannous chloride, ascorbic acid and its derivatives, amines and polyamines, hydrazine derivatives, formamidinesulfinic acid, silane compounds, and borane compounds, are known. In reduction sensitization performed for the emulsion of the present invention, it is possible to selectively use these known reduction sensitizers or to use two or more types of compounds together. Preferred reduction sensitizers in the present invention are stannous chloride, thiourea dioxide, dimethylamineborane, ascorbic acid and its derivatives. Although the addition amount of reduction sensitizers must be so selected as to meet the emulsion preparing conditions, a proper amount is $10^{-7}$ to $10^{31\ 2}$ mol per mol of a silver halide.

Reduction sensitizers are dissolved in water or a solvent, such as alcohols, glycols, ketones, esters, or amides, and the resultant solution is added during grain growth.

In the present invention, positive hole-capturing silver nuclei are preferably formed by adding reduction sensitizers at any time from the completion of nucleation and physical ripening to immediately before the termination of grain growth. In the present invention, positive hole-capturing silver nuclei can also be formed at the surface of the grain by adding reduction sensitizers after grain formation is completed.

When reduction sensitizers are added during grain formation, some silver nuclei formed can stay inside a grain, but some ooze out to form silver nuclei on the grain surface. In the present invention, these oozing silver nuclei are preferably used as positive hole-capturing silver nuclei.

In the emulsion of the present invention, when the intentional reduction sensitization is performed during a step in the midst of grain growth in order to form the positive hole-capturing nuclei inside the silver halide grain, it is necessary to perform the intentional reduction sensitization in the presence of a compound represented by general formula (I-1) or general formula (I-2). Although it is speculation but the compound of general formula (I-1) or general formula (I-2) set forth below allows stable formation of only positive hole-capturing nuclei by preventing oxidation of silver nuclei with oxidative radicals.

In addition, since the compound of the general formula (I-1) or (I-2) itself can be a reduction sensitizer, the use of other reduction sensitizer sometimes becomes unnecessary when the addition amount of these compounds is sufficient. Herein, the step in the midst of the grain growth does not include the step after the final desalting is performed. For example, a step of chemical sensitization in which silver halide grains grow as a result of the addition of a silver salt solution and fine grain silver halide, is not included.

(I-1)

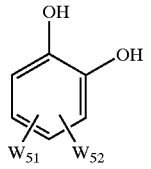

(I-2)

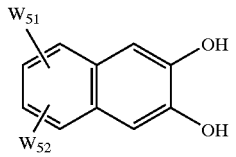

In formulas (I-1) and (I-2), each of $W_{51}$ and $W_{52}$ independently represents a sulfo group or hydrogen atom, provided that at least one of $W_{51}$ and $W_{52}$ represents a sulfo group. A sulfo group is generally an alkali metal salt such as sodium or potassium or a water-soluble salt such as ammonium salt. Favorable practical examples are 3,5-disulfocatechol disodium salt, 4-sulfocatechol ammonium salt, 2,3-dihydroxy-7-sulfonaphthalene sodium salt, 2,3-dihydroxy-6,7-disulfonaphthalene sodium salt and 2,3-dihydroxy-6,7-disulfonaphthalen potassium salt. A preferred addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is 0.0005 to 0.5 mol, and preferably, 0.003 to 0.03 mol per mol of a silver halide.

In the emulsion of the present invention, it is preferable to wash an emulsion of the present invention to form a newly prepared protective colloid dispersion for a desalting purpose. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg during washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, method using an organic solvent, method using a water-soluble polymer, and method using a gelatin derivative. The protective colloid to be used for the purpose of dispersing after washing is usually gelatin, and alkali-treated bone gelatin having a large average molecular weight containing components having molecular weight of 280,000 or more in an amount of 30 wt. or more is sometimes used advantageously.

In the emulsion of the present invention, at least one of sulfur sensitization, selenium sensitization, trillium sensitization, gold sensitization, palladium sensitization or noble metal sensitization can be performed at any point during the process of preparing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization nucleus can be selected in accordance with the intended use. However, it is preferable to form at least one type of a chemical sensitization nucleus in the vicinity of the surface.

The silver halide emulsions of the present invention are preferably subjected to selenium sensitization. The selenium sensitization that can be used in the present invention will be described. Selenium compounds disclosed in hitherto published patents can be used as the selenium sensitizer in the present invention. In the use of labile selenium compound and/or nonlabile selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the labile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the present invention, the labile selenium compounds of this broad concept can be used advantageously.

Compounds described in JP-B's-46-4553, 52-34492 and 52-34491 can be used as the nonlabile selenium compound in the present invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in a single solvent or a mixture of solvents selected from among water and organic solvents such as methanol and ethanol and added at the time of chemical sensitization. Preferably, the addition is performed prior to the initiation of chemical sensitization. The above selenium sensitizers can be used either individually or in combination. The joint use of an labile selenium compound and a nonlabile selenium compound is preferred.

The addition amount of selenium sensitizer for use in the present invention, although varied depending on the activity of employed selenium sensitizer, the type and size of silver halide, the ripening temperature and time, etc., is preferably $1\times10^{-6}$ or more per mol of silver halide. Preferably the addition amount is in the range of $1\times10^{-7}$ to $5\times10^{-5}$ mol per mol of silver halide. The temperature of chemical sensitization in the use of a selenium sensitizer is preferably in the range of 40° C. to 80° C. The pAg and pH are arbitrary. For example, with respect to pH, the advantage of the present invention can be exerted even if it widely ranges from 4 to 9.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Preferable amount of the sulfur sensitizer is in the range of $1\times10^{-4}$ to $1\times10^{-7}$ Mol per mol of silver halide, more preferably, in the range of $1\times10^{-5}$ to $5\times10^{-7}$ mol per mol of silver halide.

The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the modifier of chemical sensitization aid are described in U.S. Pat. Nos. 2,131,038, 3,411,914, and 3,554,757, JP-A-58-126526, and G. F. Duffin, Photographic Emulsion Chemistry, pages 138 to 143.

It is advantageous to use gelatin as a protective colloid for use in preparation of emulsions of the present invention or as a binder for other hydrophilic colloid layers. However, another hydrophilic colloid can also be used in place of gelatin. Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol with partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods. It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

Examples of the silver halide solvent usable in the present invention are (a) organic thioethers described in, e.g., U.S. Pat. Nos. 3,271,157, 3,531,289, and 3,574,628, and JP-A's-54-1019 and 54-158917, (b) thiourea derivatives described in, e.g., JP-A's-53-82408, 55-77737, and 55-2982, (c) a silver halide solvent having a thiocarbonyl group sandwiched between an oxygen or sulfur atom and a nitrogen atom described in JP-A-53-144319, (d) imidazoles described in JP-A-54-100717, all the disclosures of which are incorporated herein by reference (e) ammonia, and (f) thiocyanate.

Particularly preferable solvents are thiocyanate, ammonia, and tetramethylthiourea. Although the amount of a solvent used changes in accordance with the type of the solvent, a preferred amount of, e.g., thiocyanate is $1\times10^{-5}$ to $1\times10^{-2}$ mol per mol of silver halide.

An oxidizer capable of oxidizing silver is preferably used during the process of producing the emulsion of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the emulsion of the present invention are inorganic oxidizers selected from among ozone, hydrogen peroxide and its adducts, halogen elements and thiosulfonates and organic oxidizers selected from among quinones. Especially preferred oxidizers are thiosulfonates described, for example, in JP-A-2-101038.

The addition time of the oxidizer to silver may be any time of prior to the initiation of the intentional reduction sensitization, during the reduction sensitization, immediately before the completion of the reduction sensitization or immediately after the completion of the reduction sensitization. The addition can be conducted separately in several times. The addition amount of the oxidizer differs depending on the kind of the oxidizer, but preferably in the addition range of $1\times10^{-7}$ to $1\times10^{-3}$ mol per mol of silver halide.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted (1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

Besides the above-mentioned method, the addition of a chlorite in a process of emulsion preparation is very effective as a method for suppressing fog during storage of the emulsion of the present invention. The chlorite may be any salt of chlorous acid group with an alkali metal, alkali earth metal or ammonium group, but salts having high water solubility are especially preferable. Especially preferable salts are sodium chlorite and potassium chlorite.

The addition time of the chlorite in a process of emulsion preparation is not particularly limited, and the effect thereof may be exhibited at any time in the step of silver halide grain formation, the step of desalting, the step of dispersing or the step of chemical sensitization. Daring to say, the time is preferably immediately before the completion of chemical sensitization. The addition amount of the chlorite may be $10^{-8}$ mol or more and $10^{-3}$ mol or less, but preferably $10^{-6}$ mol or more and $10^{-4}$ mol or less per mol of silver halide.

The photographic emulsion for use in the present invention is preferably subjected to a spectral sensitization with a methine dye or the like to thereby exert the effects of the present invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure. These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707, GB Nos. 1,344,281 and 1,507,803, JP-B's-43-4936 and 53-12375, and JP-A's-52-110618 and 52-109925.

The emulsion used in the present invention may contain a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

Although the addition amount of the sensitizing dye is preferably $1.0\times10^{-4}$ mol or more per mol of silver halide, and more preferably about $1.5\times10^{-4}$ mol to $2\times10^{-3}$ mol per mol of silver halide, which is effective.

With respect to the photographic lightsensitive material of the present invention and the emulsion suitable for use in the photographic lightsensitive material and also with respect to layer arrangement and related techniques, silver halide emulsions, dye forming couplers, DIR couplers and other functional couplers, various additives and development processing which can be used in the photographic lightsensitive material, reference can be made to EP 0565096A1 (published on Oct. 13, 1993) and patents cited therein, all the disclosures of which are incorporated herein by reference. Individual particulars and the locations where they are described will be listed below.

1. Layer arrangement: page 61 lines 23 to 35, page 61 line 41 to page 62 line 14,
2. Interlayer: page 61 lines 36 to 40,
3. Interlayer effect-imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical ripening of emulsion: page 63 lines 6 to 9,
13. Emulsion mixing: page 63 lines 10 to 13,
14. Fogged emulsions: page 63 lines 14 to 31,
15. Nonlightsensitive emulsions: page 63 lines 32 to 43,
16. Silver coating amounts: page 63 lines 49 to 50.
17. The additives are described in detail in Research Disclosure Item 17643 (December 1978), Item 18716 (November 1979) and Item 307105 (November 1989), the disclosures of which are incorporated herein by reference. A summary of the locations where they are described will be listed in the following table.

| | Types of additives | RD17643 | RD18716 | RD307105 |
|---|---|---|---|---|
| 1 | Chemical sensitizers | page 23 | page 648 right column | page 866 |
| 2 | Sensitivity increasing agents | | page 648 right column | |
| 3 | Spectral sensitizers, super-sensitizers | pages 23–24 | page 648, right column to page 649, right column | pages 866 to 868 |
| 4 | Brighteners | page 24 | page 647, right column | page 866 |
| 5 | Antifoggants, stabilizers | pages 24–25 | page 649, right column | pages 868 to 870 |
| 6 | Light absorbents, filter dyes, ultraviolet absorbents | pages 25–26 | page 649, right column to page 650, left column | page 873 |
| 7 | Stain preventing agents | page 25, right column | page 650, left to right columns | page 872 |
| 8 | Dye image stabilizers | page 25 | page 650, left column | page 872 |
| 9 | Film hardeners | page 26 | page 651, left column | pages 874 to 875 |
| 10 | Binders | page 26 | page 651, left column | pages 873 to 874 |
| 11 | Plasticizers, lubricants | page 27 | page 650, right column | page 876 |

-continued

| | Types of additives | RD17643 | RD18716 | RD307105 |
|---|---|---|---|---|
| 12 | Coating aids, surfactants | pages 26–27 | page 650, right column | pages 875 to 876 |
| 13 | Antistatic agents | page 27 | page 650, right column | pages 876 to 877 |
| 14 | Matting agents | | | pages 878 to 879 |

18. Formaldehyde scavengers: page 64 lines 54 to 57,
19. Mercapto-type antifoggants: page 65 lines 1 to 2,
20. Fogging agent, etc. releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler summary: page 65 lines 39 to 44,
28. Bleaching accelerator-releasing couplers: page 65 lines 45 to 48,
29. Development accelerator-releasing couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swell speed: page 66 line 40 to page 67 line 1,
35. Back layers: page 67 lines 3 to 8,
36. Development processing summary: page 67 lines 9 to 11,
37. Developing solution and developing agents: page 67 lines 12 to 30,
38. Developing solution additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing, rinse and stabilization: page 69 line 41 to page 70 line 18,
45. Processing solution replenishment and recycling: page 70 lines 19 to 23,
46. Developing agent built-in sensitive material: page 70 lines 24 to 33,
47. Development processing temperature: page 70 lines 34 to 38, and
48. Application to lens-fitted film: page 70 lines 39 to 41

Moreover, preferred use can be made of a bleaching solution containing 2-pyridinecarboxylic acid or 2,6-pyridinedicarboxylic acid, a ferric salt such as ferric nitrate and a persulfate as described in EP No. 602,600, the disclosure of which is incorporated herein by reference. When this bleaching solution is used, it is preferred that the steps of stop and water washing be conducted between the steps of color development and bleaching. An organic acid such as acetic acid, succinic acid or maleic acid is preferably used in the stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter referred to as "L").

EXAMPLE

The following are examples of the present invention. However, the present invention is not limited to the examples.

Example 1

This example shows advantages in silver halide tabular grains having a grain thickness of 0.1 μm or less exhibited by enhancement of the uniformity of surface iodide distribution in main planes between grains and the uniformity of the same in individual grains. The example also shows an effect exhibited by distributing high iodide content phases circularly in an imaginary plane parallel to a main plane present in the depth of 20% the tabular grain thickness from the main plane.

(Method for Preparation of Gelatin Used for Preparation of Silver Halide Emulsion)

Gelatin-1 to gelatin-3 used as protective colloid dispersion media in the preparation of emulsions described below have the following attributes.

Gelatin-1: Common alkali-processed ossein gelatin made from bovine bones.

Gelatin-2: Gelatin formed by adding succinic anhydride to an aqueous solution of gelatin-1 at 50 C and pH 9.0 to cause chemical reaction, removing the residual succinic acid, and drying the resultant material. The ratio of the number of chemically modified —$NH_2$ groups in the gelatin was 98%.

Gelatin-3: Gelatin formed by decreasing the molecular weight of gelatin-1 by allowing enzyme to act on it such that the average molecular weight was 15,000, deactivating the enzyme, further oxidizing methionine residue in the gelatin by adding aqueous hydrogen peroxide at 40° C. and pH 6.0 and drying the resultant material. The ratio of the number of oxidized methionine residues in the gelatin was 90% or more.

All of gelatin-1 to gelatin-3 described above were deionized and so adjusted that the pH of an aqueous 5% solution at 35° C. was 6.0.

(Preparation of Solid Fine Dispersions of Sensitizing Dyes Used in Spectral Sensitization of Silver Halide Emulsions)

In the following emulsion preparation, sensitizing dyes used in spectral sensitization were used in the form of fine solid dispersions prepared by a method described in JP-A-11-52507. For example, a fine solid dispersion of a sensitizing dye Exs-7 was prepared by dissolving 0.8 part by weight of $NaNO_3$ and 3.2 parts by weight of $Na_2SO_4$ in 43 parts by weight of ion-exchanged water, adding 3 parts by weight of the sensitizing dye Exs-7, and dispersing the material at 60° C. for 20 minutes using a dissolver blade at 2,000 rpm.

Exs-7

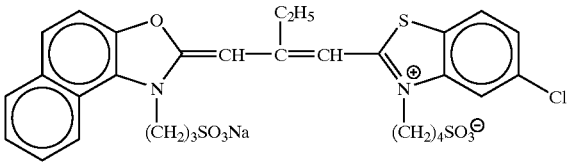

(Preparation of Emulsion EM-1A of a Comparative Example)

820 milliliters (milliliters will also be referred to as "mL" hereinafter) of an aqueous solution containing 0.62 g of KBr and 3.1 g of gelatin-3 described above was stirred at 35° C. (first solution preparation). 24 mL of aqueous solution Ag-1 (containing 4.9 g of $AgNO_3$ in 100 mL), 24 mL of aqueous solution X-1 (containing 4.1 g of KBr in 100 mL), and 11.8 mL of aqueous solution G-1 (containing 3.6 g of gelatin-3 in 100 mL) were added over 45 seconds at fixed flow rates by the triple jet method (addition 1). After that, 1.35 g of KBr was added, and the temperature was raised to 75° C. to ripen the material. Immediately before the completion of the ripening, 150 mL of aqueous solution G-2 (containing 15.0 g of gelatin-2 described above in 100 mL) was added, and then pH of the bulk emulsion solution was adjusted to 5.6 by addition of dilute sulfuric acid.

Next, 21.6 mL of aqueous solution Ag-1 was added over 1 minute at a fixed flow rate (addition 2), and then the addition of silver bromide fine grains having an average equivalent spherical diameter of 18 nm (addition 3) was commenced. Addition 3 was effected by the addition of 70.8 g, in terms of silver nitrate, of silver bromide fine grains over 47 minutes at a fixed flow rate. During this addition, pAg was regulated by addition of aqueous solution X-1 such that the pAg of the bulk emulsion solution be held at 7.9.

The silver bromide fine grains having an average equivalent spherical diameter of 18 nm were formed using a mixing device having a structure shown in FIG. 1 provided in JP-A-10-239787, and immediately after that, the fine grains were added to an emulsion comprising silver halide fine grains serving as a host. A mixing device having a mixing space with a volume of 0.7 mL was used and the residence time in the mixing space of the addition solutions introduced to the mixing device each containing water-soluble silver salt, water-soluble halide and gelatin was adjusted to 1.2 seconds.

Subsequently, 38.6 mL of aqueous solution Ag-2 (containing 32.0 g of $AgNO_3$ in 100 mL) and aqueous solution X-2 (containing 26.0 g of KBr in 100 mL) were added over 5 minutes by the double jet method. The addition of the aqueous solution Ag-2 was effected at a fixed flow rate. The addition of the aqueous solution X-2 was effected so that the pAg of the bulk emulsion solution in the reaction vessel was held at 8.15 (addition 4).

Afterward, 200 mL of aqueous solution G-3 (containing 20.0 g of gelatin-1 in 100 mL) was added, followed by reduction of temperature to 55° C. Subsequently, 85.9 mL of aqueous solution Ag-3 (containing 10.0 g of $AgNO_3$ in 100 mL) and 282 mL of aqueous solution X-3 (containing 2.5 g of KI in 100 mL) were added over 5 minutes by the double jet method (addition 5).

Subsequently, following the sequential addition of 0.0007 g of sodium benzenethiosulfonate, 0.0045 g of 2-mercaptobenzothioazole and 0.036 g of potassium hexacyanoruthenate (II), 175 ml of aqueous solution Ag-2 and aqueous solution X-2 were added over 29 minutes by the double jet method. The addition of the aqueous solution Ag-2 was effected at a fixed flow rate. The addition of the aqueous solution X-2 was effected so that the pAg of the bulk emulsion solution in the reaction vessel was held at 7.9 (addition 6).

After the completion of addition 6, desalting was performed by conventional flocculation. Subsequently, water, NaOH and gelatin-1 were added under stirring, and the pH and the pAg were adjusted to 5.8 and 8.8, respectively, at 5° C.

The resultant emulsion comprised silver halide tabular grains having an equivalent spherical diameter of 0.74 μm, an average equivalent-circle diameter of main planes of 1.80 μm, a variation coefficient of the equivalent-circle diameter of 25%, an average grain thickness of 0.082 μm, an average aspect ratio of 22, and an average iodide content of 4.8 mol %, and having (111) planes as parallel main planes. All tabular grains having main planes with an equivalent-circle diameter of 1.0 μm or more had a grain thickness of 0.1 μm or less and they accounted for 94% of the total projected area.

For grains chosen at random from the grains having main planes with an equivalent-circle diameter of 1.0 μm or more, the iodide distribution in the main plane of each grain was examined by TOF-SIMS. A specimen comprising a silicon wafer having silver halide grains applied thereon was prepared by the method described in the main body of this specification. Measurement was performed using $Ga^+$ ions as a primary ion, at an acceleration voltage of 25 kV under conditions such that a spatial resolution of 100 nm can be obtained. During the measurement, the specimen was cooled to −120° C. or cooler and the secondary ion of iodide was measured in negative ion measuring mode. Bromide was detected simultaneously with iodide and a surface iodide content was calculated. The surface iodide content was represented by the following equation:

$$\text{(Surface iodide content)}=\alpha\times\text{(Iodine detection intensity)}/\text{(Bromide detection intensity}+\alpha\times\text{Iodine detection intensity)}$$

In the above equation, α is a device constant for correcting a difference between secondary ion detection efficiencies of bromide and iodide. For every individual grain, the surface iodide distribution in a grain was measured reticulatedly for every 100 nm square and the variation coefficient of iodide content of each measurement point was obtained.

After the measurement of iodide content in the main plane, the surface of the specimen was etched to the depth of 20% of the average grain thickness using $Ga^+$ ions in the TOF-SIMS apparatus and the iodide distribution in the plane newly exposed was measured in the same manner as the measurement of the aforementioned surface iodide distribution.

Grains were chosen until the sum of their projected area reached 70% or the total projected area in the order of increasing variation coefficient of iodide content in the main plane, and then the average of the variation coefficients (hereinafter referred to as SVA) was calculated. SVA was found to be 47%. The grains chosen at random from the grains having an equivalent-circle diameter of 1.0 μm or more had an average value of iodide contents in the main plane, i.e., Io, of 3.7 mol %. Among these grains, those having an intragrain average of iodide contents of the main plane, i.e., Is, satisfying the relation: $0.7Io<Is<1.3Io$ accounted for 45% of the total projected area.

As for the iodide distribution in the plane newly exposed after the etching to the depth of 20% of the grain thickness, the measurement points at which the iodide content was a maximum distributed in a region apart from the center of the plane by from 70 to 95% of the distance from the center of the plane to the border line regardless of direction from the center of the plane. The average of the maximum values in all directions was 30 mol % and the average variation coefficient was 29%, and the measurement points at which the iodide content was a maximum distributed circularly.

The emulsion prepared above was optimally, chemically sensitized by adding compound PRZ-1, presented below, and sensitizing dyes Exs-7, Exs-8 and Exs-9, also presented below, at a molar ratio of 70:29:1, and then sequentially adding potassium thiocyanate, chloroauric acid, sodium thiosulfate and N,N-dimethylselenourea. The chemical sensitization was completed by adding water-soluble mercapto compounds MER-1 and MER-2, presented below, at a ratio of 97:3 such that their combined amount was $4.7\times10^{-4}$ mol per mol of silver halide. This emulsion EM-1A was optimally, chemically sensitized when the addition amount of the PRZ-1 was $5.84\times10^{-5}$ mol per mol of silver halide and the addition amount of the sensitizing dyes was $1.46\times10^{-3}$ mol per mol of silver halide.

PRZ-1

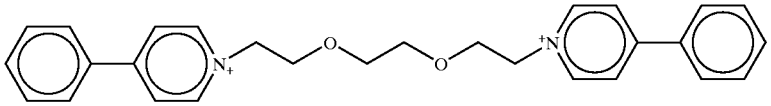

Exs-7

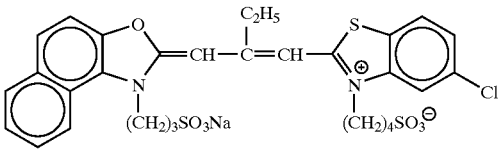

Exs-8

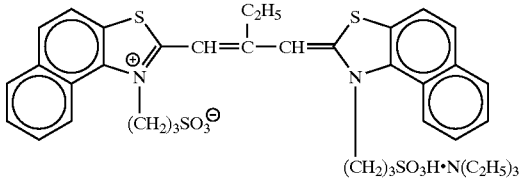

Exs-9

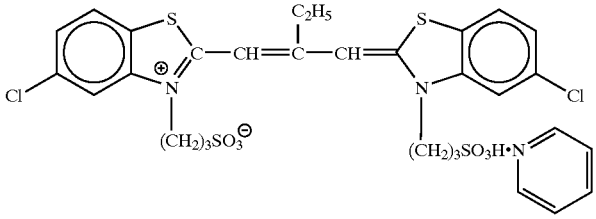

-continued

MER-1

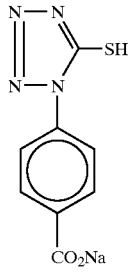

MER-2

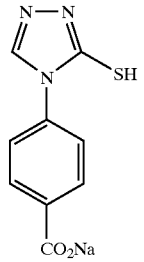

(Preparation of Emulsion EM-1B of the Present Invention)

Emulsion EM-1B was prepared by making the following modifications to the preparation conditions of the above-described emulsion EM-1A.

In (addition 4), the addition amount of aqueous solution Ag-2 was changed to 54 mL, and the addition time for aqueous solutions Ag-2 and X-2 was changed to 7 minutes.

Subsequently, (addition 5) effected after the addition of aqueous solution G-3 and the temperature reduction to 55° C. was changed to a step comprising adding 7.86 g of iodoacetamide, which is the example compound (2) of the iodide ion-releasing agent described in the main body of this specification, and fully stirring, subsequently adding sodium hydroxide to adjust the pH of the bulk emulsion solution contained in the reaction vessel to 9.5, and further adding 6.42 g of sodium sulfite to release iodide ions to the reaction vessel. Further, after (addition 5), sulfuric acid was added to adjust the pH of the bulk emulsion solution contained in the reaction vessel to 5.6.

Moreover, in (addition 6), the addition amount of aqueous solution Ag-2 was changed to 186 mL, and the addition time for aqueous solutions Ag-2 and X-2 was changed to 31 minutes.

The grain size distribution, the shape of grains and the average AgI content of the resultant emulsion were almost the same as those of emulsion EM-1A.

SVA was determined in the same manner as in the case of emulsion EM-1A. SVA was found to be 45%. The grains chosen at random from the grains having an equivalent-circle diameter of 1.0 μm or more had an average value of iodide contents of main planes, i.e., Io, of 4.2 mol %. Among these grains, those having an intragrain average of iodide contents of main planes, i.e., Is, satisfying the relation: 0.7Io<Is<1.3Io accounted for 73% of the total projected area.

As for the iodide distribution in the plane newly exposed after the etching to the depth of 20% of the grain thickness, the measurement points at which the iodide content was a maximum distributed in a region apart from the center of the plane by from 70 to 95% of the distance from the center of the plane to the border line regardless of direction from the center of the plane. The average of the maximum values in all directions was 25 mol % and the average variation coefficient thereof was 28%. Thus, the measurement points at which the iodide content was a maximum distributed circularly.

EM-1B was chemically sensitized under almost the same conditions as those for EM-1A.

(Preparation of Emulsion EM-1C of the Present Invention)

Emulsion EM-1C was prepared by changing, in the preparation conditions of the above-described emulsion EM-1B, the temperature employed in the steps after (addition 5) to 40° C.

The grain size distribution, the shape of grains and the average AgI content of the resultant emulsion were almost the same as those of emulsion EM-1A.

SVA was determined in the same manner as in the case of emulsion EM-1A. SVA was found to be 29%. The grains chosen at random from the grains having an equivalent-circle diameter of 1.0 μm or more had an average value of iodide contents of main planes, i.e., Io, of 4.0 mol %. Among these grains, those having an intragrain average of iodide contents of main planes, i.e., Is, satisfying the relation: 0.7Io<Is<1.3Io accounted for 83% of the total projected area.

As for the iodide distribution in the plane newly exposed after the etching to the depth of 20% of the grain thickness, the measurement points at which the iodide content was a maximum distributed in a region apart from the center of the plane by from 70 to 90% of the distance from the center of the plane to the border line regardless of direction from the center of the plane. The average of the maximum values in all directions was 24 mol % and the average variation coefficient thereof was 25%. Thus, the measurement points at which the iodide content was a maximum distributed circularly.

EM-1C was chemically sensitized under almost the same conditions as those for EM-1A.

(Preparation of Eemulsion EM-1D of the Present Invention)

Emulsion EM-1D was prepared by changing, in the preparation conditions of the above-described emulsion EM-1B, the temperature employed in the step of (addition 5) to 30° C. and the temperature employed in the step of (addition 6) to 40° C.

The grain size distribution, the shape of grains and the average iodide content of the resultant emulsion were almost the same as those of emulsion EM-1A.

SVA was determined in the same manner as in the case of emulsion EM-1A. SVA was found to be 19%. The grains chosen at random from the grains having an equivalent-circle diameter of 1.0 μm or more had an average value of iodide contents of main planes, i.e., Io, of 4.0 mol %. Among these grains, those having an intragrain average of iodide contents of main planes, i.e., Is, satisfying the relation: 0.7Io<Is<1.3Io accounted for 93% of the total projected area and those having Is satisfying the relation: 0.8Io<Is<1.2Io accounted for more than 70% of the total projected area.

As for the iodide distribution in the plane newly exposed after the etching to the depth of 20% of the grain thickness, the measurement points at which the iodide content was a maximum distributed in a region apart from the center of the plane by from 70 to 90% of is15 the distance from the center of the plane to the border line regardless of direction from the center of the plane. The average of the maximum values in all directions was 25 mol % and the average variation coefficient thereof was 21%. Thus, the measurement points at which the iodide content was a maximum distributed circularly.

EM-1D was chemically sensitized under almost the same conditions as those for EM-1A.

(Preparation of Emulsion EM-1E of an Comparative Example)

Emulsion EM-1E was prepared by changing, in the preparation conditions of the above-described emulsion EM-1B, the amounts of iodoacetamide and sodium sulfite added in (addition 5) to 3.93 g and 3.21 g, respectively.

The grain size distribution and the shape of grains of the resultant emulsion were almost the same as those of emulsion EM-1A. The average iodide content was 2.4 mol %.

SVA was determined in the same manner as in the case of emulsion EM-1A. SVA was found to be 41%. The grains chosen at random from the grains having an equivalent-circle diameter of 1.0 $\mu$m or more had an average value of iodide contents of main planes, i.e., Io, of 3.1 mol %. Among these grains, those having an intragrain average of iodide contents of main planes, i.e., Is, satisfying the relation: $0.7Io<Is<1.3Io$ accounted for 74% of the total projected area.

As for the iodide distribution in the plane newly exposed after the etching to the depth of 20% of the grain thickness, the measurement points at which the iodide content was a maximum distributed in a region apart from the center of the plane by from 70 to 95% of the distance from the center of the plane to the border line regardless of direction from the center of the plane. The average of the maximum values in all directions was 20 mol % and the average variation coefficient thereof was 36%. Thus, the measurement points at which the iodide content was a maximum did not distribute circularly.

EM-1E was chemically sensitized under almost the same conditions as those for EM-1A.

(Preparation of Emulsion EM-1F of the Present Invention)

Emulsion EM-1F was prepared by changing, in the preparation conditions of the above-described emulsion EM-1D, the amounts of iodoacetamide and sodium sulfite added in (addition 5) to 3.93 g and 3.21 g, respectively.

The grain size distribution and the shape of grains of the resultant emulsion were almost the same as those of emulsion EM-1A. The average iodide content was 2.4 mol %.

SVA was determined in the same manner as in the case of emulsion EM-1A. SVA was found to be 25%. The grains chosen at random from the grains having an equivalent-circle diameter of 1.0 $\mu$m or more had an average value of iodide contents of main planes, i.e., Io, of 2.9 mol %. Among these grains, those having an intragrain average of iodide contents of main planes, i.e., Is, satisfying the relation: $0.7Io<Is<1.3Io$ accounted for 93% of the total projected area and those having Is satisfying the relation: $0.8Io<Is<1.2Io$ accounted for more than 70% of the total projected area.

As for the iodide distribution in the plane newly exposed after the etching to the depth of 20% of the grain thickness, the measurement points at which the iodide content was a maximum distributed in a region apart from the center of the plane by from 70 to 90% of the distance from the center of the plane to the border line regardless of direction from the center of the plane. The average of the maximum values in all directions was 21 mol % and the average variation coefficient thereof was 37%. Thus, the measurement points at which the iodide content was a maximum did not distribute circularly.

EM-1F was chemically sensitized under almost the same conditions as those for EM-1A.

Emulsions EM-1A to EM-1F described above were observed at a liquid nitrogen temperature using a 400-kV transmission electron microscope. In all of the emulsions, grains accounting for 50% or more of the total projected area had, in their peripheral portions, 10 or more dislocation lines per grain. It is to be noted that in EM-1A, EM-1B, EM-1C and EM-1D, dislocation lines were present in every portion in the peripheral portions of grains, but in EM-1E and EM-1F, dislocation lines were localized in the vicinities of the corners and almost no dislocation lines were found in the edge portions. Further, in EM-1B and EM-1E were found some grains having specifically many dislocation lines in a part of the central region of a main plane.

Cellulose triacetate film supports having thereon an undercoat layer were coated with emulsions EM-1A to EM-1F under the coating conditions as shown in Table 1 below.

TABLE 1

Emulsion coating condition (1) Emulsion layer
- Emulsion . . . each emulsion (silver $1.63 \times 10^{-2}$ mol/m$^2$)
- Coupler ($2.26 \times 10^{-3}$ mol/m$^2$)

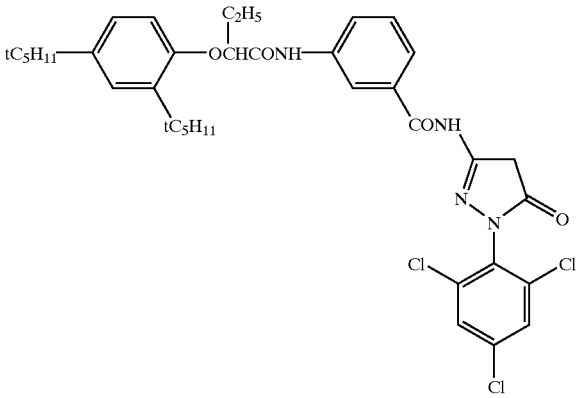

- Tricresyl phosphate (1.32 g/m$^2$)
- Gelatin (3.24 g/m$^2$)

(2) Protective layer
- 2.4-dichloro-6-hydroxy-s-triazine sodium salt (0.08 g/m$^2$)
- Gelatin (1.80 g/m$^2$)

These samples were subjected to a film hardening process at 40° C. and a relative humidity of 70% for 14 hours. The resultant samples were exposed for 1/100 sec through the SC-50 gelatin filter, a long wavelength light-transmitting filter having a cut off wavelength of 500 nm, manufactured by Fuji Photo Film Co., Ltd. and a continuous wedge. The density of each sample developed as described later was measured through a green filter to evaluate the photographic properties.

Evaluation of resistance to pressure was performed using specimens prepared from the aforementioned coated samples by bending them at an angle of 30° for 10 seconds at a temperature of 25° C. and at a relative humidity of 55% and then subjecting them to exposure and development similar to those described above. The resistance to pressure can be evaluated through comparison of photographic properties of the bent portions and the non-bent portions.

By using the FP-350 negative processor manufactured by Fuji Photo Film Co., Ltd., the resultant samples were processed by the following method until the accumulated replenisher amount of each solution was three times the mother solution tank volume.

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) | common to tank solution and replenisher (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2 \cdot 2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-mononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The attributes of the coated emulsions and the results of evaluation of the photographic properties are shown in Table 2 below. The sensitivity is indicated by the relative value of the reciprocal of an exposure amount required to reach a density of fog density plus 0.2. The sensitivity of the emulsion EM-1A is assumed to be 100.

The result of evaluation of resistance to pressure is indicated by "rate of change in density caused by pressure." If "density in bent portion" indicates the density obtained when a bent portion is exposed at an exposure amount at which a density of 2.2 is given in a non-bent portion, the "rate of change in density caused by pressure" is a value calculated using the following formula:

$$\text{"Rate of change in density caused by pressure"} = (\text{"Density in bent portion"}/2.2-1)\times 100(\%)$$

In the formula, 2.2 is the density in the non-bent portion. The closer to 0 the (rate of change in density caused by pressure), the smaller the range of change in photographic properties caused by the application of pressure and the more desirable.

TABLE 2

| Emulsion | Ratio of grains meeting 0.7 Io < Is < 1.3 Io with respect to the total projected area (%) | SVA value (%) | Iodide content in an imaginary plane that is present in a depth of 20% of the grain thickness from the main plane and that is parallel to the main plane | Sensitivity *1 | Rate of change in density by pressure (%) |
|---|---|---|---|---|---|
| EM-1A Comp. | 45 | 47 | Measurement points having the maximum iodide content distribute circularly | 100 | −25 |
| EM-1B Inv. | 73 | 45 | Measurement points having the maximum iodide content distribute circularly | 133 | −14 |
| EM-1C Inv. | 83 | 29 | Measurement points having the maximum iodide content distribute circularly | 180 | −3 |
| EM-1D Inv. | 93 | 19 | Measurement points having the maximum iodide content distribute circularly | 188 | −1 |
| EM-1E Inv. | 74 | 41 | Measurement points having the maximum iodide content do not distribute circularly | 108 | −19 |
| EM-1F Inv. | 93 | 25 | Measurement points having the maximum iodide content do not distribute circularly | 160 | −3 |

*1: The sensitivity is a relative value assuming the sensitivity of Em-1A as 100.

It is apparent from a comparison of EM-1A with EM-1B to EM-1D that emulsions of the present invention comprising silver halide tabular grains having small variation coefficients of iodide content in main planes both between grains and in individual grains are preferable because they exhibit high sensitivities and they show small changes in photographic properties when pressure is applied.

It is also apparent from a comparison of EM-1B with EM-1E and a comparison of EM-1D with EM-1F that emulsions of the present invention wherein in a plane newly exposed after the etching to the depth of 20% of the grain thickness, the measurement points at which the iodide content is a maximum distribute circularly show sensitivities higher than those exhibited by emulsions of the present invention wherein the measurement points at which the iodide content is a maximum do not distribute circularly.

Example 2

In this example is shown an advantage produced by changing the method for forming high iodide content phases from the emulsions of the present invention prepared in Example 1 and preparing emulsions so that a strong induce fluorescence near 575 nm can be emitted when an electromagnetic wave of 325 nm is transmitted under the environment where silver halide grains are cooled to an absolute temperature of 6° K.

(Preparation of Emulsion EM-2A of the Present Invention)

Emulsion EM-2A was prepared by making the following modifications to the preparation conditions of emulsion EM-1A of Example 1.

After the completions of (addition 4) and the addition of aqueous solution G-3, the temperature was lowered to 50° C. 6.0 g of KBr was added to adjust the pAg of the bulk emulsion solution contained in the reaction vessel to 9.5. After 2 minutes, addition of silver iodide fine grains having an average equivalent spherical diameter of 9.5 nm (addition 5-1) was commenced. After additional 10 seconds, additions of aqueous solutions Ag-2 and X-2 by the double jet method (addition 5-2) was commenced. (Addition 5-1) was performed by adding 7.2 g, in terms of silver nitrate, of silver iodide fine grains over 2.1 minutes at a fixed flow rate. With respect to (addition 5-2), 51.3 mL of aqueous solution Ag-2 was added over 4.8 minutes at a fixed flow rate and the addition of aqueous solution X-2 was performed so that the pAg of the bulk emulsion solution was held at 9.5.

The silver iodide fine grains having an average equivalent spherical diameter of 9.5 nm were formed using a mixing device having a structure shown in FIG. 1 provided in JP-A-10-239787, and immediately after that, the fine grains were added to an emulsion comprising silver halide fine grains each serving as a host. A mixing device having a mixing space with a volume of 0.7 mL was used and the residence time during which the addition solution introduced to the mixing device containing water-soluble silver salt, water-soluble halide and gelatin was adjusted to 0.4 seconds.

After the temperature was lowered to 40%, sodium benzenethiosulfonate, 2-mercaptobenzothiazole and potassium hexacyanoruthenate (II) were added in the same manner as in the case of EM-1A. After that, (addition 6) was performed by adding 128 mL of aqueous solution Ag-2 and aqueous solution X-2 in the double jet method over 21.3 minutes. The addition of aqueous solution Ag-2 was performed at a fixed flow rate. The addition of X-2 was performed so that the pAg of the bulk emulsion solution contained in the reaction vessel was held at 7.9. The conditions employed after (addition 6) were the same as those for emulsion EM-1A.

The grain size distribution, the shape of grains and the average iodide content of the resultant emulsion were almost the same as those of emulsion EM-1A.

SVA was determined in the same manner as in the case of emulsion EM-1A. SVA was found to be 20%. The grains chosen at random from the grains having an equivalent-circle diameter of 1.0 $\mu$m or more had an average value of iodide contents of main planes, i.e., Io, of 4.0 mol %. Among these grains, those having an intragrain average of iodide contents of main planes, i.e., Is, satisfying the relation: $0.7Io<Is<1.3Io$ accounted for 90% of the total projected area and those having Is satisfying the relation: $0.8Io<Is<1.2Io$ accounted for more than 70% of the total projected area.

As for the iodide distribution in the plane newly exposed after the etching to the depth of 20% of the grain thickness, the measurement points at which the iodide content was a maximum distributed in a region apart from the center of the plane by from 70 to 90% of the distance from the center of the plane to the border line regardless of direction from the center of the plane. The average of the maximum values in all directions was 24 mol % and the average variation coefficient thereof was 21%. Thus, the measurement points at which the iodide content was a maximum distributed circularly.

(Preparation of Emulsion EM-2B of the Present Invention)

Emulsion EM-2B was prepared by making the following modifications to the preparation conditions of the above-described emulsion EM-2A.

The aforementioned (addition 5-1) was performed by adding 3.6 g, in terms of silver nitrate, of silver iodide fine grains over 1.0 minute at a fixed flow rate. With respect to (addition 5-2), 25.7 mL of aqueous solution Ag-2 was added over 2.4 minutes at a fixed flow rate and the addition of aqueous solution X-2 was performed simultaneously so that the pAg of the bulk emulsion solution was held at 9.5.

(Addition 6) was performed by adding 165 mL of aqueous solution Ag-2 and aqueous solution X-2 in the double jet method over 27.5 minutes. The addition of aqueous solution Ag-2 was performed at a fixed flow rate. The addition of X-2 was performed so that the pAg of the bulk emulsion solution contained in the reaction vessel was held at 7.9. The conditions employed from (addition 6) and thereafter were the same as those for emulsion EM-1A.

The grain size distribution and the shape of grains of the resultant emulsion were almost the same as those of emulsion EM-1A. The average iodide content was 2.4 mol %.

SVA was determined in the same manner as in the case of emulsion EM-1A. SVA was found to be 27%. The grains chosen at random from the grains having an equivalent-circle diameter of 1.0 $\mu$m or more had an average value of iodide contents of main planes, i.e., Io, of 2.8 mol %. Among these grains, those having an intragrain average of iodide contents of main planes, i.e., Is, satisfying the relation: $0.7Io<Is<1.3Io$ accounted for 91% of the total projected area and those having Is satisfying the relation: $0.8Io<Is<1.2Io$ accounted for more than 70% of the total projected area.

As for the iodide distribution in the plane newly exposed after the etching to the depth of 20% of the grain thickness, the measurement points at which the iodide content was a maximum distributed in a region apart from the center of the plane by from 70 to 90% of the distance from the center of the plane to the border line regardless of direction from the center of the plane. The average of the maximum values in all directions was 20 mol % and the average variation coefficient thereof was 38%. Thus, the measurement points at which the iodide content was a maximum did not distribute circularly.

Emulsions EM-2A and EM-2B described above were observed at a liquid nitrogen temperature using a 400-kV transmission electron microscope. In both emulsions, grains accounting for 50% or more of the total projected area had, in their peripheral portions, 10 or more dislocation lines per grain. It is to be noted that in EM-2A, dislocation lines were present in every portion in the peripheral portions of grains, but in EM-2B, dislocation lines were localized in the vicinities of the corners and almost no dislocation lines were found in the edge portions.

Cellulose triacetate film supports having thereon an undercoat layer were coated with emulsions EM-2A and EM-2B, and emulsions EM-1A to EM-1F of Example 1.

These specimens were cooled to an absolute temperature of 6° K. using helium and induced fluorescent spectrum was measured with 325-nm electromagnetic wave irradiation. In EM-2A and EM-2B, clear induced fluorescence was observed near 575 nm and the intensity thereof exceeded ⅓ the intensity of the fluorescence in the wavelength range of from 490 to 560 nm. In contrast, in EM-1A to EM-1F, induced fluorescence near 575 nm was unclear and the intensity thereof was less than ⅓ the intensity of the fluorescence in the wavelength range of from 490 to 560 nm.

Coating of emulsions EM-2A and EM-2B and emulsions EM-1A, EM-1D and EM-1F of Example 1 was performed under the same conditions as in Example 1, and photographic properties and resistance to pressure were evaluated.

The results are given in Table 3 below. The sensitivity is indicated using a relative value obtained when the sensitivity of emulsion EM-1A is taken as 100.

TABLE 3

| Emulsion | Ratio of grains meeting 0.7 Io < Is < 1.3 Io with respect to the total projected area (%) | SVA value (%) | Iodide content in an imaginary plane that is present in a depth of 20% of the grain thickness from the main plane and that is parallel to the main plane | Intensity of induced fluorescence 575 nm *1 | Sensitivity *2 | Rate of change in density by pressure (%) |
|---|---|---|---|---|---|---|
| Em-1A Comp. | 45 | 47 | Inv. | weak | 100 | −25 |
| Em-1D Inv. | 93 | 19 | Measurement points having the maximum iodide content distribute circularly | weak | 188 | −1 |
| Em-1F Inv. | 93 | 25 | Measurement points having the maximum iodide content do not distribute circularly | weak | 160 | −3 |
| Em-2A Inv. | 90 | 20 | Measurement points having the maximum iodide content distribute circularly | strong | 200 | −1 |
| Em-2B Inv. | 91 | 27 | Measurement points having the maximum iodide content do not distribute circularly | strong | 170 | −1 |

*1: Intensity of induced fluorescence near 575 nm is "strong" means that the intensity thereof is one third or more of the maximum intensity of the fluorescent light emitted in a wavelength range of 490 to 560 nm. Intensity of induced fluorescence near 575 nm is "weak" means that the intensity thereof is less than one third of the fluorescent light emitted in a wavelength range of 490 to 560 nm..

*2: The sensitivity is a relative value assuming the sensitivity of Em-1A as 100

When the formation of a high iodide content layer is performed in a way using silver iodide fine grains, the ratio of fluorescence near 575 nm in the induced fluorescence emitted at extremely low temperature increases. The results given in Table 3 show that in the situation mentioned above, the advantages of the present invention are conspicuous. Emulsion EM-2A, which emits a strong induced fluorescence near 575 nm when an electromagnetic wave of 325 nm is transmitted at an absolute temperature of 6° K., is inferior to emulsion EM-1D, which emits a weak induced fluorescence near 575 nm, in both the uniformity of iodide content in main planes between grains and that in individual grains, but has a higher sensitivity. A similar relation is observed between emulsions EM-1E and EM-2B, both having no circular distribution of measurement points at which the iodide content is a maximum.

Example 3

In this example is shown the advantage of the present invention in emulsions of tabular grains within the range where main planes have an equivalent-circle diameter of 3.0 μm or more.

(Preparation of Emulsion EM-3A of a Comparative Example)

1100 mL of an aqueous solution containing 0.90 g of KBr and 4.0 g of gelatin-3 described above was stirred at 35° C. (first solution preparation). 37 mL of aqueous solution Ag-1 (containing 0.53 g of $AgNO_3$ in 100 mL), 37 mL of aqueous solution X-1 (containing 0.6 g of KBr in 100 mL), and 18 mL of aqueous solution G-1 (containing 1.8 g of gelatin-3 in 100 mL) were added over 53 seconds at fixed flow rates by the triple jet method (addition 1). After that, the temperature was raised to 75° C. to ripen the material. Immediately before the completion of the ripening, 100 mL of aqueous solution G-2 (containing 15.0 g of gelatin-2 described above in 100 mL) was added, and then pH of the bulk emulsion solution was adjusted to 5.6 by addition of dilute sulfuric acid. Further, 0.88 g of KBr was added.

35.9 mL of aqueous solution Ag-2 (containing 32.0 g of $AgNO_3$ in 100 mL) and 34.4 mL of aqueous solution X-2 (containing 26.0 g of KBr in 100 mL) were added over 29 seconds while the flow rates of the solutions were accelerated (addition 2). The flow rate acceleration was performed so that the flow rate at the completion of addition becomes 2.7 times the flow rate at the beginning of the addition. After that, addition of silver iodobromide fine grains having an average equivalent spherical diameter of 16 nm and an iodide content of 2.9 mol % was commenced (addition 3). (Addition 3) was performed by adding 80.7 g, in terms of silver nitrate, of silver bromide fine grains over 63 minutes at a fixed flow rate. pAg was regulated by addition of aqueous solution X-3 (containing 5.1 g of KBr in 100 mL) such that the pAg of the bulk emulsion solution is held 8.03.

The silver bromide fine grains having an average equivalent spherical diameter of 16 nm were formed using a mixing device having a structure shown in FIG. 1 provided in JP-A-10-239787, and immediately after that, the fine grains were added to an emulsion comprising silver halide fine grains each serving as a host. A mixing device having a mixing space with a volume of 0.1 mL was used and the residence time during which the addition solution introduced to the mixing device containing water-soluble silver salt, water-soluble halide and gelatin was adjusted to 0.4 seconds.

Subsequently, 114 mL of aqueous solution Ag-2 and aqueous solution X-2 were added over 24 minutes by the double jet method. The addition of aqueous solution Ag-2 was performed at a fixed flow rate. The addition of aqueous solution X-2 was performed so that the pAg of the bulk emulsion solution contained in the reaction vessel was held at 8.15 for the first 15 minutes and the pAg of the bulk emulsion solution after that was held at 7.65 (addition 4).

After that, following to addition of 135 mL of aqueous solution G-3 (containing 10.0 g of gelatin-1 described above in 100 mL), the temperature was lowered to 55° C., and further 2.4 g of KBr and 0.0008 g of sodium benzenethiosulfonate were sequentially added. Subsequently, 88.0 mL of aqueous solution Ag-4 (containing 10.0 g of $AgNO_3$ in 100 mL) and 291 mL of aqueous solution X-4 (containing 2.5 g of KI in 100 mL) were added over 5 minutes by the double jet method (addition 5).

After that, following to addition of 0.0015 g of 2-mercaptobenzothiazole, the temperature was lowered to 40° C. Subsequently, 87.9 mL of aqueous solution Ag-2 and aqueous solution X-2 were added over 12 minutes by the double jet method. The addition of aqueous solution Ag-2 was performed at a fixed flow rate. The addition of aqueous solution X-2 was performed so that the pAg of the bulk emulsion solution contained in the reaction vessel was held at 9.70 (addition 6).

Further, after 0.006 g of potassium hexacyanoruthenate (II) was added, 115 mL of aqueous solution Ag-2 and aqueous solution X-2 were added over 39 minutes by the double jet method. The addition of aqueous solution Ag-2 was performed at a fixed flow rate. The addition of aqueous solution X-2 was performed so that the pAg of the bulk emulsion solution contained in the reaction vessel was held at 8.25 (addition 7).

After addition of 6.4 g of KBr following to the completion of addition 7, desalting was performed by normal flocculation. Subsequently, water, NaOH and gelatin-1 were added under stirring, and the pH and the pAg were adjusted to 5.8 and 8.8, respectively, at 50° C.

The resultant emulsion comprised silver halide tabular grains having an equivalent spherical diameter of 1.07 μm, an average equivalent-circle diameter of main planes of 3.05 μm, an average grain thickness of 0.088 μm, an average aspect ratio of 34, and an average iodide content of 4.8 mol %, and having (111) planes as parallel main planes. All tabular grains having main planes with an equivalent-circle diameter of 1.0 μm or more had a grain thickness of 0.1 μm or less and they accounted for 98% of the total projected area.

In the same manner as Example 1, for grains chosen at random from the grains having main planes with an equivalent-circle diameter of 1.0 μm or more, the iodide distribution in main planes of each grain was examined by TOF-SIMS. Further, after a main plane was etched to the depth of 20% of the grain thickness, the iodide distribution in the exposed plane was measured in the same manner as the above-described surface iodide distribution.

Grains were chosen until the sum of their projected area reached 70% or the total projected area in the order of increasing variation coefficient of iodide content in a main plane, and then the average of the variation coefficients was calculated in the same manner as Example 1. SVA was found to be 50%. The grains chosen at random from the grains having an equivalent-circle diameter of 1.0 μm or more had an average value of iodide contents of main planes, i.e., Io, of 3.5 mol %. Among these grains, those having an intragrain average of iodide contents of main planes, i.e., Is, satisfying the relation: $0.7Io<Is<1.3Io$ accounted for 48% of the total projected area.

As for the iodide distribution in the plane newly exposed after the etching to the depth of 20% of the grain thickness, the measurement points at which the iodide content was a maximum distributed in a region apart from the center of the plane by from 75 to 95% of the distance from the center of the plane to the border line regardless of direction from the center of the plane. The average of the maximum values in all directions was 29 mol % and the average variation coefficient thereof was 29%. Thus, the measurement points at which the iodide content was a maximum distributed circularly.

The emulsion prepared above was optimally, chemically sensitized by adding compound PRZ-1, presented below, and sensitizing dyes Exs-7, Exs-8 and Exs-9, also presented below, at a molar ratio of 70:29:1, and then sequentially adding potassium thiocyanate, chloroauric acid, sodium thiosulfate and N,N-dimethylselenourea. The chemical sensitization was completed by adding water-soluble mercapto compounds MER-1 and MER-2, presented below, at a ratio of 97:3 such that their combined amount was $3.0\times10^{-4}$ mol per mol of silver halide. This emulsion EM-3A was optimally, chemically sensitized when the addition amount of the PRZ-1 was $4.58\times10^{-5}$ mol per mol of silver halide and the addition amount of the sensitizing dyes was $1.05\times10^{-3}$ mol per mol of silver halide.

PRZ-1

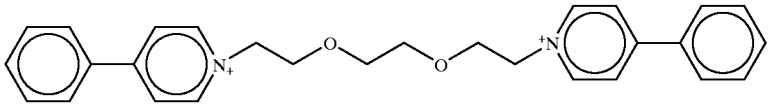

Exs-7

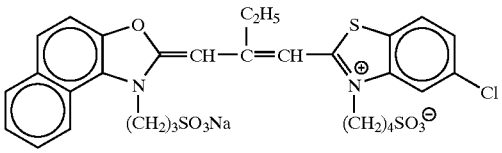

Exs-8

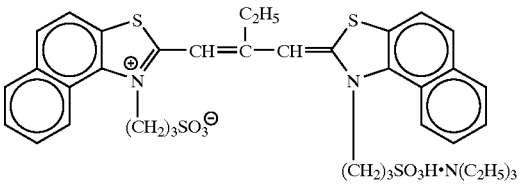

Exs-9

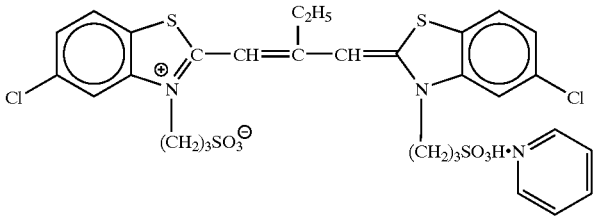

MER-1

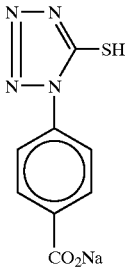

MER-2

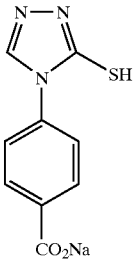

(Preparation of Emulsion EM-3B of the Present Invention)

Emulsion EM-3B was prepared by making the following modifications to the preparation conditions of emulsion EM-3A described above.

After the completions of (addition 4) and the addition of aqueous solution G-3, the temperature was lowered to 50° C. 11.4 g of KBr was added to adjust the pAg of the bulk emulsion solution contained in the reaction vessel to 9.5 and then 0.0008 g of sodium benzenethiosulfonate was added. After 2 minutes, addition of silver iodide fine grains having an average equivalent spherical diameter of 9.5 nm (addition 5-1) was commenced. After additional 10 seconds, additions of aqueous solutions Ag-2 and X-2 by the double jet method (addition 5-2) was commenced. (Addition 5-1) was performed by adding 7.4 g, in terms of silver nitrate, of silver iodide fine grains over 2.1 minutes at a fixed flow rate. With respect to (addition 5-2), 52.9 mL of aqueous solution Ag-2 was added over 5.7 minutes at a fixed flow rate and the addition of aqueous solution X-2 was performed so that the pAg of the bulk emulsion solution was held at 9.5.

The silver iodide fine grains having an average equivalent spherical diameter of 9.5 nm were formed using a mixing device having a structure shown in FIG. 1 provided in JP-A-10-239787, and immediately after that, the fine grains were added to an emulsion comprising silver halide fine grains each serving as a host. A mixing device having a mixing space with a volume of 0.7 mL was used and the residence time during which the addition solution introduced to the mixing device containing water-soluble silver salt, water-soluble halide and gelatin was adjusted to 0.4 seconds.

After that, following to addition of 0.0015 g of 2-mercaptobenzothiazole, the temperature was lowered to 40° C. Subsequently, 39.4 mL of aqueous solution Ag-2 and aqueous solution X-2 were added over 5.5 minutes by the double jet method. The addition of aqueous solution Ag-2 was performed at a fixed flow rate. The addition of aqueous solution X-2 was performed so that the pAg of the bulk emulsion solution contained in the reaction vessel was held at 9.90 (addition 6).

Further, potassium hexacyanoruthenate (II) was added in the same manner as EM-3A and, subsequently, the steps from (addition 7) and thereafter were performed in the same manner as EM-3A.

The grain size distribution, the shape of grains and the average iodide content of the resultant emulsion were almost the same as those of emulsion EM-3A.

Coating of emulsions EM-3A and EM-3B described above was performed under the same conditions as in Examples 1 and 2, and photographic properties and resistance to pressure were evaluated. The results are given in Table 4 below. The sensitivity is indicated using a relative value obtained when the sensitivity of emulsion EM-3A is taken as 100.

TABLE 4

| Emulsion | Ratio of grains meeting 0.7 Io < Is < 1.3 Io with respect to the total projected area (%) | SVA value (%) | Iodide content in an imaginary plane that is present in a depth of 20% of the grain thickness from the main plane and that is parallel to the main plane | Intensity of induced fluorescence near 575 nm *1 | Sensitivity *2 | Rate of change in density by pressure (%) |
|---|---|---|---|---|---|---|
| EM-3A Comp. | 48 | 50 | Measurement points having the maximum iodide content distribute circularly | weak | 100 | −35 |
| EM-3B Inv. | 86 | 20 | Measurement points having the maximum iodide content distribute circularly | strong | 217 | −2 |

*1: Intensity of induced fluorescence near 575 nm is "strong" means that the intensity thereof is one third or more of the maximum intensity of the fluorescent light emitted in a wavelength range of 490 to 560 nm. Intensity of induced fluorescence near 575 nm is "weak" means that the intensity thereof is less than one third of the fluorescent light emitted in a wavelength range of 490 to 560 nm..
*2: The sensitivity is a relative value assuming the sensitivity of Em-3A as 100

SVA was determined in the same manner as in the case of EM-3A described above. SVA was found to be 20%. The grains chosen at random from the grains having an equivalent-circle diameter of 1.0 μm or more had an average value of iodide contents of main planes, i.e., Io, of 3.8 mol %. Among these grains, those having an intragrain average of iodide contents of main planes, i.e., Is, satisfying the relation: 0.7Io<Is<1.3Io accounted for 86% of the total projected area and those having Is satisfying the relation: 0.8Io<Is<1.2Io accounted for more than 70% of the total projected area.

As for the iodide distribution in the plane newly exposed after the etching to the depth of 20% of the grain thickness, the measurement points at which the iodide content was a maximum distributed in a region apart from the center of the plane by from 75 to 90% of the distance from the center of the plane to the border line regardless of direction from the center of the plane. The average of the maximum values in all directions was 24 mol % and the average variation coefficient thereof was 23%. Thus, the measurement points at which the iodide content was a maximum distributed circularly.

Emulsions EM-3A and EM-3B described above were observed at a liquid nitrogen temperature using a 400-kV transmission electron microscope. In both emulsions, grains accounting for 50% or more of the total projected area had, in their peripheral portions, or more dislocation lines per grain.

Fluorescent spectrum at an absolute temperature of 6° K. was measured in the same manner as Example 2. In EM-3B, clear induced fluorescence was observed near 575 nm and the intensity thereof exceeded ⅓ the intensity of the fluorescence in the wavelength range of from 490 to 560 nm. In contrast, in EM-3A, induced fluorescence near 575 nm was unclear and the intensity thereof was less than ⅓ the intensity of the fluorescence in the wavelength range of from 490 to 560 nm.

In this example, the equivalent-circle diameter of main planes is 3.05 μm, which is greater than that in Example 2, 1.80 μm. Relations between EM-3A (a comparative example) and EM-3B (the present invention) are basically the same as those between EM-1A (a comparative example) and EM-2A (the present invention) in Example 2. The comparison of performances of these emulsions shows that the advantages of the present invention are conspicuous when the equivalent-circle diameter of main planes is large.

Example 4

The silver halide emulsions EM-1A to EM-1F and EM-2A to EM-2B prepared in Examples 1 and 2 described above were introduced to the fifth layer (medium-speed red-sensitive emulsion layer) of the color negative multilayered light-sensitive material described below, and the sensitivity, pressure property and storage stability were evaluated.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamidoepichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form a sample as a color negative sensitized material.

(Compositions of Sensitive Layers)

The main ingredients used in the individual layers are classified as follows, however, the use thereof are not limited to those specified below.

ExC: Cyan coupler UV: Ultraviolet absorbent
ExM: Magenta coupler HBS: High-boiling organic solvent
ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| **First layer (First antihalation layer)** | | |
| Black colloidal silver | silver | 0.155 |
| Silver iodobromide emulsion T | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| **Second layer (Second antihalation layer)** | | |
| Black colloidal silver | silver | 0.066 |
| Gelatin | | 0.407 |
| ExM-1 | | 0.050 |
| ExF-1 | | 2.0 × 10$^{-3}$ |
| HBS-1 | | 0.074 |
| Solid disperse dye ExF-2 | | 0.015 |
| Solid disperse dye ExF-3 | | 0.020 |
| **Third layer (Intermediate layer)** | | |
| Silver iodobromide emulsion R | | 0.020 |
| ExC-2 | | 0.022 |
| Polyethylacrylate latex | | 0.085 |
| Gelatin | | 0.294 |
| **Fourth layer (Low-speed red-sensitive emulsion layer)** | | |
| Silver chloroiodobromide emulsion M | silver | 0.065 |
| Silver chloroiodobromide emulsion L | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| **Fifth layer (Medium-speed red-sensitive emulsion layer)** | | |
| Silver iodobromide emulsion of Examples 1 and 2 | silver | 0.83 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |

-continued

| | | |
|---|---|---|
| Cpd-4 | | 0.028 |
| HBS-1 | | 0.16 |
| Gelatin | | 1.18 |
| Sixth layer (High-speed red-sensitive emulsion layer) | | |
| Silver chloroiodobromide emulsion K | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| Seventh layer (Intermediate layer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| Eighth layer (layer for donating multilayer effect to red-sensitive layer) | | |
| Silver iodobromide emulsion J | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| Ninth layer (Low-speed green-sensitive emulsion layer) | | |
| Silver chloroiodobromide emulsion I | silver | 0.39 |
| Silver chloroiodobromide emulsion H | silver | 0.28 |
| Silver iodobromide emulsion G | silver | 0.35 |
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |
| Tenth layer (Medium-speed green-sensitive emulsion layer) | | |
| Silver iodobromide emulsion G | silver | 0.30 |
| Silver iodobromide emulsion F | silver | 0.18 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| Eleventh layer (High-speed green-sensitive emulsion layer) | | |
| Silver chloroiodobromide emulsion E | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |
| Twelfth layer (Yellow filter layer) | | |
| Yellow colloidal silver | silver | 0.047 |
| Cpd-1 | | 0.16 |

-continued

| | | |
|---|---|---|
| Solid disperse dye ExF-6 | | 0.015 |
| Oil-soluble dye ExF-5 | | 0.010 |
| HBS-1 | | 0.082 |
| Gelatin | | 1.057 |
| Thirteenth layer (Low-speed blue-sensitive emulsion layer) | | |
| Silver chloroiodobromide emulsion D | silver | 0.18 |
| Silver iodobromide emulsion B | silver | 0.20 |
| Silver chloroiodobromide emulsion C | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| Fourteenth layer (High-speed blue-sensitive emulsion layer) | | |
| Silver iodobromide emulsion A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| Fifteenth layer (First protective layer) | | |
| Silver iodobromide emulsion R | silver | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| F-20 | | 0.005 |
| HBS-1 | | 0.12 |
| HBS-4 | | $5.0 \times 10^{-2}$ |
| Gelatin | | 2.3 |
| Sixteenth layer (Second protective layer) | | |
| H-1 | silver | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt and rhodium salt.

A method for producing the silver halide emulsions (except the emulsions prepared in Examples 1 and 2) used for the above color negative multilayered light-sensitive material and characteristic values of this material are described below.

(Gelatins Used in the Preparation of Silver Halide Emulsions and Methods of Manufacturing the Same)

Gelatin-1, gelatin-2 and gelatin-4 to gelatin-6 used as protective colloid dispersion media in the preparation of emulsions have the following attributes.

Gelatin-1: the same gelatin as gelatin-1 of Example 1

Gelatin-2: the same gelatin as gelatin-2 of Example 1

Gelatin-4: Gelatin formed by decreasing the molecular weight of gelatin-1 by allowing enzyme to act on it so that the average molecular weight was 15,000, deactivating the enzyme, and drying the resultant material.

Gelatin-5: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-6: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

All of gelatin-1, gelatin-2 and gelain-4 to gelatin-6 described above were deionized and so adjusted that the pH of an aqueous 5% solution at 35° C. was 6.0.

Silver halide emulsions A to M were prepared by the following manufacturing method.

(Preparation Method of Emulsion A)

42.2L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of gelatin-5 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90.

After washing with water, gelatin-1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion. 1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1 was added, the pH and the pAg were adjusted to 5.8 and 8.7, respectively, at 40° C. After TAZ-1 was added the temperature was raised to 60° C. After sensitizing dyes ExS-2 and ExS-3 set forth below were added, potassium thiocyanate, chloroauric acid, sodium thiosulfate, and N,N-dimethylselenourea were added to optimally perform chemical sensitization. At the end of this chemical sensitization, MER-1 and MER-2 were added. "Optimal chemical sensitization" means that the addition amount of each of the sensitizing dyes and the compounds was $10^{-1}$ to $10^{-8}$ mol per mol of a silver halide.

TAZ-1

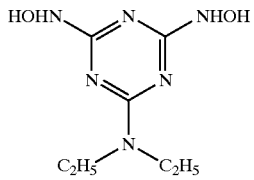

Exs-2

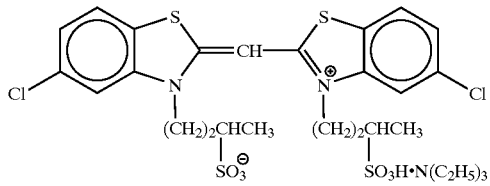

Exs-3

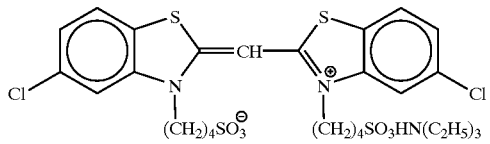

MER-1

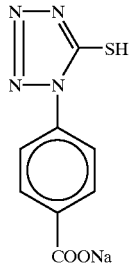

MER-2

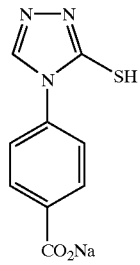

(Manufacturing Method of Emulsion B)

1,192 mL of an aqueous solution containing 0.96 g of gelatin-5 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the completion of the ripening, 35 g of gelatin-6 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 15.8 mol %. At the same time, the pAg of the bulk emulsion solution in the reaction vessel was held at 7.85. 96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was decreased to 55° C., an aqueous KBr solution was added to adjust the pAg of the bulk emulsion solution in the reaction vessel to 9.80.

The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized in substantially the same manner as for the emulsion A.

(Manufacturing Method of Emulsion C)

1,192 mL of an aqueous solution containing 1.02 g of gelatin-5 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the completion of the ripening, 41.2 g of gelatin-6 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 2.3 mol %. At the same time, the pAg of the bulk emulsion solution in the reaction vessel was held at 8.50. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the completion of the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water and chemically sensitized in substantially the same manner as for the emulsion A.

(Manufacturing Method of Emulsion D)

In the preparation of the emulsion C, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. The emulsion was prepared following substantially the same procedures as for the emulsion C except the foregoing.

(Manufacturing Method of Emulsion E)

1,200 mL of an aqueous solution containing 0.38 g of gelatin-5 and 0.9 g of KBr were held at 60° C. and stirred with violence at pH 2.0. An aqueous solution containing 1.03 g of $AgNO_3$ and an aqueous KBr solution containing 0.88 g of KBr and 0.09 g of KI were added over 30 sec by the double jet method. After the completion of the ripening, 12.8 g of gelatin-2 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of Emulsion A was simultaneously added such that the silver iodide content was 6.5 mol %. At the same time, the pAg of the bulk emulsion solution in the reaction vessel was held at 9.05.

After 1.5 mg of thiourea dioxide was added, 132 mL of an aqueous solution containing 41.8 g of $AgNO_3$ and an aqueous KBr solution were added by the double jet method over 16 min. The addition of the KBr aqueous solution was so adjusted that the pAg of the bulk emulsion solution in the reaction vessel was 7.70. After 2 mg of sodium benzenethiosulfonate was added, the pAg of the bulk emulsion solution in the reaction vessel was adjusted to 9.80 by the addition of KBr, and 6.2 g, in terms of a KI weight, of the before mentioned silver iodide fine grain emulsion was added. Immediately after the completion of the addition, 300 mL of an aqueous solution containing 88.5 g of $AgNO_3$ was added over 10 min. The addition of the KBr solution was so adjusted that the pAg of the bulk emulsion solution in the reaction vessel at the completion of the addition was 7.40. After washing with water, gelatin-1 was added, and the pH and the pAg were adjusted to 6.5 and 8.2, respectively at 40° C. Next, TAZ-1 was added. After raising the temperature to 58° C., spectral sensitizing dyes Exs-1, Exs-4 and Exs-5 were added, then potassium thiocyanate, chloroauric acid, sodium thiosulfate, and N,N-dimethylselenourea were subsequently added to optimally perform chemical sensitization. At the completion of the chemical sensitization, MER-1 and MER-2 were added.

TAZ-1

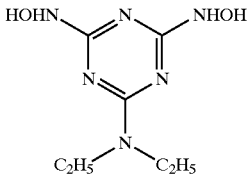

Exs-4

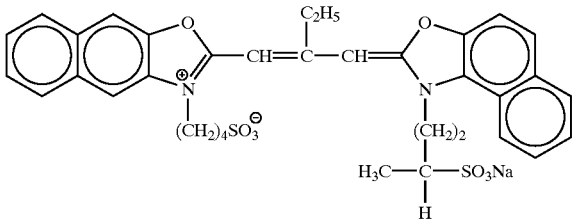

Exs-5

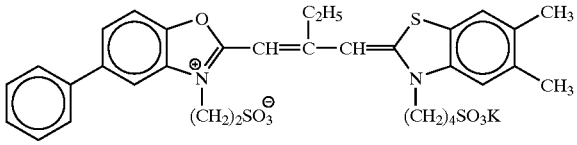

Exs-1

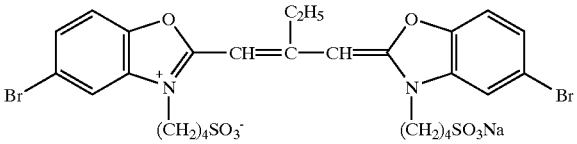

MER-1

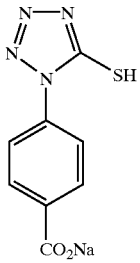

MER-2

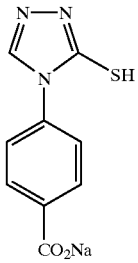

(Manufacturing Method of Emulsion F)

1,200 mL of an aqueous solution containing 0.75 g of gelatin-5 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-5 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion used in the preparation of Emulsion A was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and 1 mg of thiourea dioxide was added. After KBr was added to adjust the pAg of the bulk emulsion solution in the reaction vessel to 9.50, the aforementioned AgI fine grain emulsion was added in an amount of 5.73 in terms of a KI weight. Immediately after the completion of the addition, 609 mL of an aqueous solution containing 66.4 g of $AgNO_3$ were added over 10 min. For the first 6 min of the addition, the pAg of the bulk emulsion solution in the reaction vessel was held at 9.50 by an aqueous KBr solution. After washing with water, gelatin-1 was added, and the pH and the pAg were adjusted to 6.5 and 8.2, respectively, at 40° C., and then TAZ-1 was added. After spectral sensitizing dyes ExS-1, ExS-4, and ExS-5 were added, chemical sensitization was performed in the same manner as in Emulsion E.

(Manufacturing Method of Emulsion G)

1,200 mL of an aqueous solution containing 0.70 g of gelatin-4, 0.9 g of KBr, 0.175 g of KI, and 0.2 g of the modified silicone oil used in the preparation of the emulsion D were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the completion of the ripening, 27.8 g of gelatin-6 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grains formed by using a mixing vessel having a structure described in FIG. 1 of JP-A-10-239787, as in Example 1, was added so that the silver iodide content became 4.1 mol %. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion A was added in an amount of 5.73 g in terms of a KI weight. Immediately after the completion of the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized in almost the same manner as for the emulsion E.

(Manufacturing Method of Emulsion H)

An aqueous solution containing 17.8 g of gelatin-1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 were added to ripen the material. After the completion of the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion A was added in an amount of 6.3 g in terms of a KI weight. Immediately after the completion of the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized almost the same manner as for the emulsion E.

(Manufacturing Method of Emulsion I)

An emulsion I was prepared following almost the same procedures as for the emulsion H except that the nucleation temperature was changed to 35° C.

(Manufacturing Method of Emulsion J)

1,200 mL of an aqueous solution containing 0.75 g of gelatin-4 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the completion of the ripening, 20 g of gelatin-5 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion used in the preparation of Emulsion A was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the above-mentioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the completion of the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, TAZ-1 was added. The spectral sensitizing dyes ExS-1 and ExS-6 were added. After that, potassium thiocyanate, chloroauric acid, sodium thiosulfate, and N,N-dimethylselenourea were added to optimally chemically sensitize the emulsion. At the end of the chemical sensitization, MER-1 and MER-2 were added.

TAZ-1

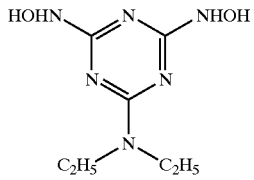

Exs-6

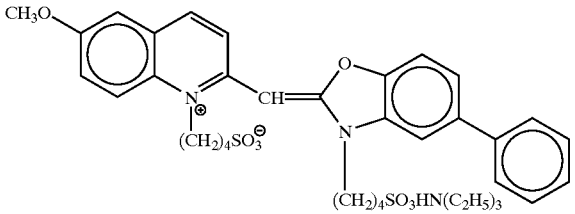

Exs-1

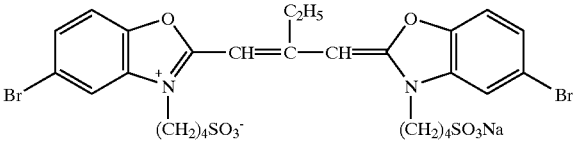

-continued

MER-1

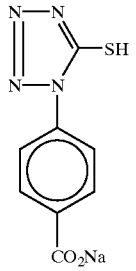

MER-2

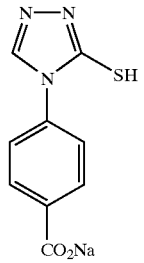

(Manufacturing Method of Emulsion K)

1,200 mL of an aqueous solution containing 0.38 g of gelatin-5 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After the completion of the ripening, 12.8 g of gelatin-6 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion A was simultaneously added at an accelerated flow rate such that the silver iodide content was 6.5 mol %. At the same time, the pAg of the bulk emulsion solution in the reaction vessel was held at 9.05. After 1.5 mg of thiourea dioxide were added, 132 mL of an aqueous solution containing 41.8 g of $AgNO_3$ and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 was added, the pH and the pAg were adjusted to 6.5 and 8.2, respectively, at 40° C. After TAZ-1 was added, the temperature was raised to 58° C. Spectral sensitizing dyes ExS-7, ExS-8, and ExS-9 set forth below were added. After that, $K_2IrCl_6$, potassium thiocyanate, chloroauric acid, sodium thiosulfate, and N,N-dimethylselenourea were added to optimally perform chemical sensitization. At the end of the chemical sensitization, MER-1 and MER-2 were added.

TAZ-1

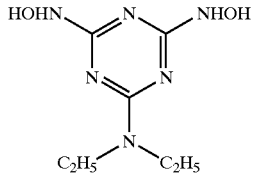

Exs-7

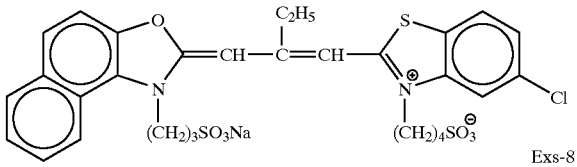

Exs-8

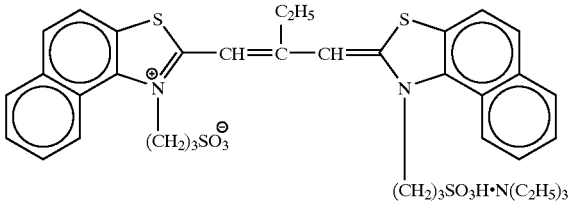

Exs-9

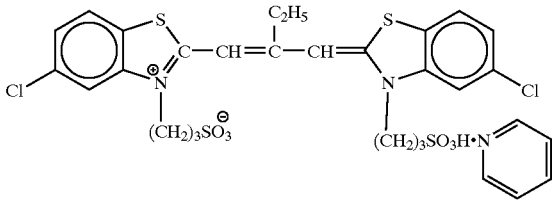

MER-1

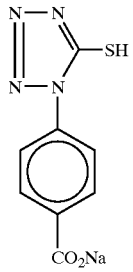

MER-2

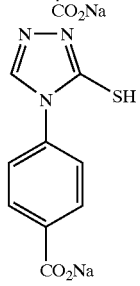

(Manufacturing Methods of Emulsions L and M)

Emulsions L and M were prepared following substantially the same procedures as for the emulsions H and I, respectively, except that chemical sensitization was performed in almost the same manner as for the emulsion K.

Characteristic values of the above silver halide emulsions are summarized in Table 5 below. The surface iodide content can be examined as follows by XPS. That is, a sample was cooled to −115° C. in a vacuum of 1×10 torr or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the emulsions D to Q.

TABLE 5

| Emulsion No. | ECD (μm) COV (%) | Grain thickness (μm) COV (%) | Aspect ratio COV (%) | Tabularity | Twin plane distance (μm) COV (%) | Ratio of tabular grains having (111) main planes to the total projected area (%) | (100) plane ration in side faces (%) | Iodide content (mol %)] COV (%) | Chloride content (mol %) | Surface iodide content (mol %) |
|---|---|---|---|---|---|---|---|---|---|---|
| A | 1.98 | 0.198 | 10 | 51 | 0.014 | 92 | 23 | 15 | 0 | 4.3 |
| | 23 | 28 | 35 | | 32 | | | 17 | | |
| B | 1.30 | 0.108 | 12 | 111 | 0.013 | 93 | 22 | 11 | 0 | 3.6 |
| | 25 | 27 | 38 | | 30 | | | 16 | | |
| C | 1.00 | 0.083 | 12 | 145 | 0.012 | 93 | 18 | 4 | 1 | 1.8 |
| | 27 | 26 | 37 | | 30 | | | 8 | | |
| D | 0.75 | 0.075 | 10 | 133 | 0.010 | 91 | 33 | 4 | 2 | 1.9 |
| | 31 | 18 | 29 | | 27 | | | 8 | | |
| E | 2.38 | 0.138 | 17 | 125 | 0.013 | 98 | 23 | 5 | 1 | 1.6 |
| | 20 | 20 | 23 | | 19 | | | 6 | | |
| F | 1.54 | 0.077 | 20 | 260 | 0.013 | 99 | 23 | 7 | 0 | 2.5 |
| | 26 | 18 | 33 | | 26 | | | 7 | | |
| G | 1.08 | 0.072 | 15 | 208 | 0.008 | 97 | 23 | 6 | 0 | 2.0 |
| | 18 | 15 | 19 | | 22 | | | 5 | | |
| H | 0.44 | 0.220 | 2 | 9 | 0.013 | 90 | 38 | 3 | 2 | 1.0 |
| | 16 | 13 | 9 | | 18 | | | 6 | | |
| I | 0.33 | 0.165 | 2 | 12 | 0.013 | 88 | 42 | 3 | 2 | 1.0 |
| | 17 | 13 | 12 | | 18 | | | 6 | | |
| J | 2.25 | 0.107 | 21 | 197 | 0.013 | 99 | 20 | 7.2 | 0 | 2.4 |
| | 31 | 19 | 34 | | 33 | | | 7 | | |
| K | 2.38 | 0.138 | 17 | 125 | 0.013 | 98 | 23 | 5 | 1 | 1.6 |
| | 20 | 20 | 23 | | 19 | | | 6 | | |
| L | 0.44 | 0.220 | 2 | 9 | 0.013 | 88 | 42 | 2 | 2 | 1.0 |
| | 17 | 13 | 12 | | 18 | | | 6 | | |
| M | 0.33 | 0.165 | 2 | 12 | 0.013 | 88 | 46 | 1 | 2 | 0.5 |
| | 17 | 13 | 12 | | 18 | | | 6 | | |
| N | 0.07 | 0.070 | 1 | — | — | — | — | 1 | 0 | — |
| | — | — | — | | — | | | — | | |
| O | 0.07 | 0.070 | 1 | — | — | — | — | 0.9 | 0 | — |
| | — | — | — | | — | | | — | | |

ECD = Equivalent circle diameter COV = Coefficient of variation

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethylene-ether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, solid dispersions ExF-4 was obtained. The average grain sizes of these fine dye grains was 0.45. ExF-2 was dispersed by a microprecipitation dispersion method described in Example 1 of EP549,489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1

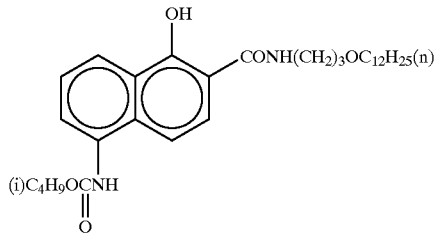

ExC-2

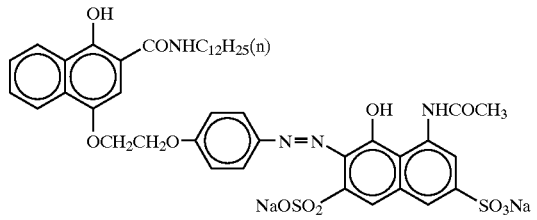

-continued
ExC-3
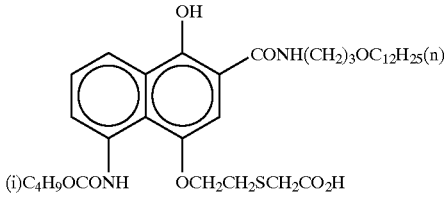
ExC-4
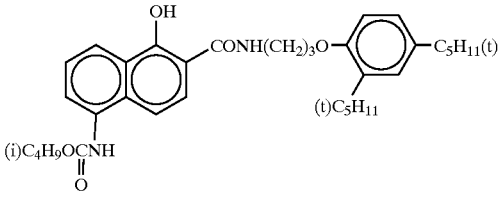
ExC-5
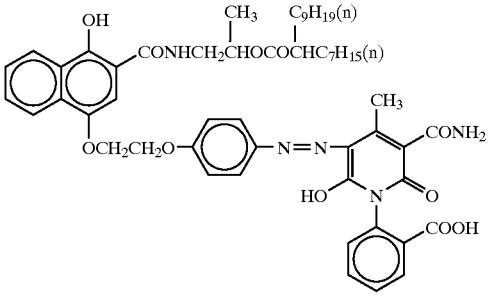
ExC-6
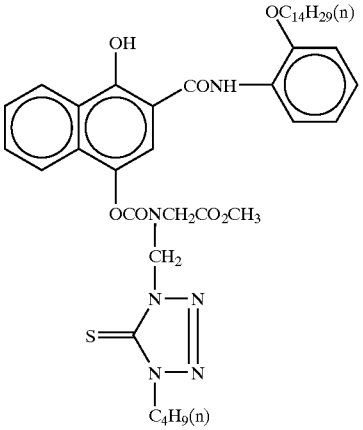
ExC-7
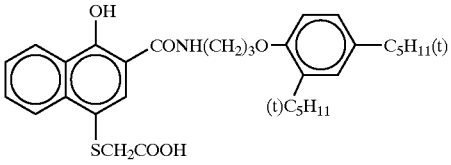
ExC-8
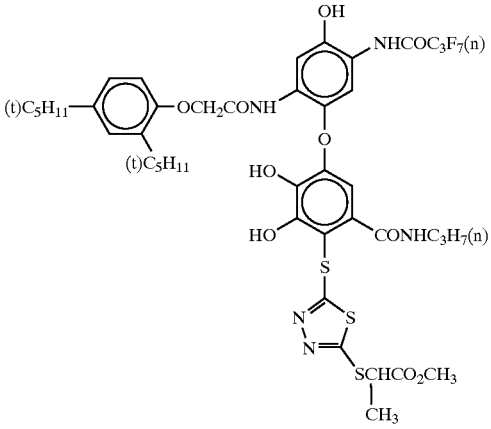
ExM-1
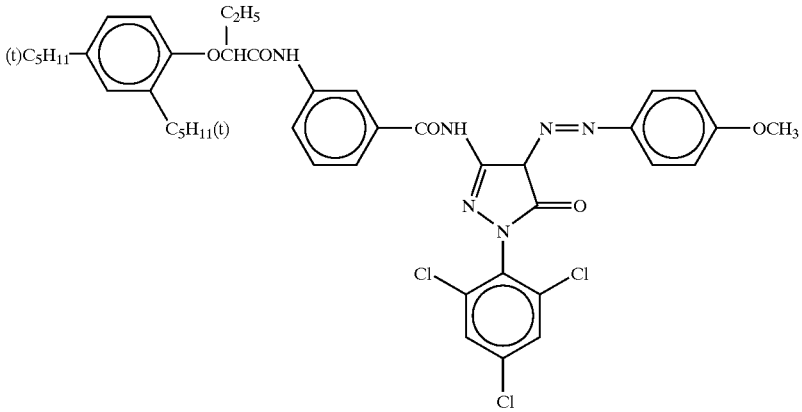

-continued
ExM-2
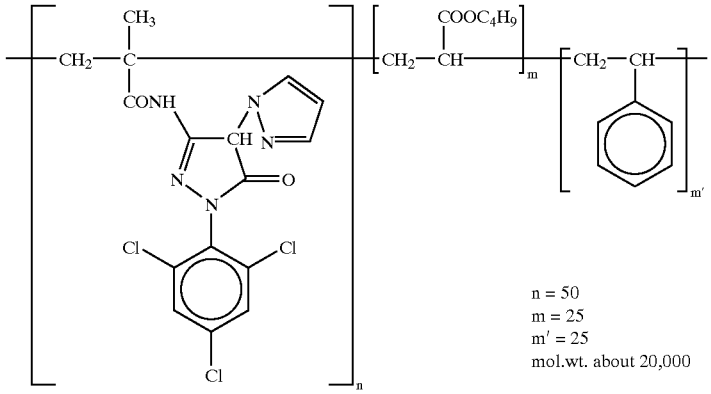
ExM-3
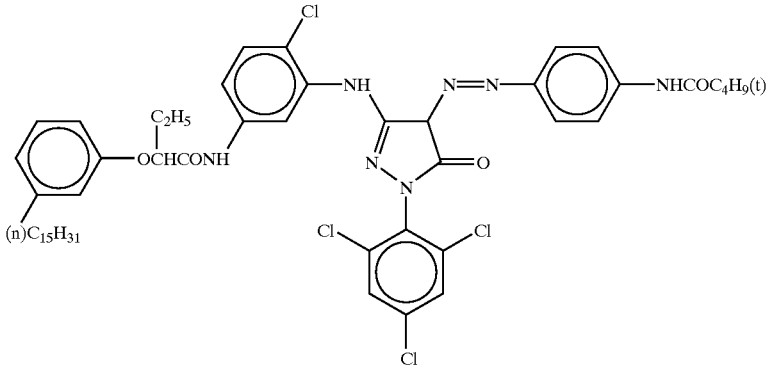
ExM-4
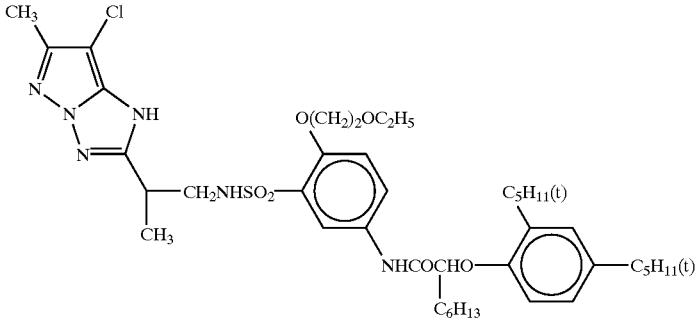
ExM-5
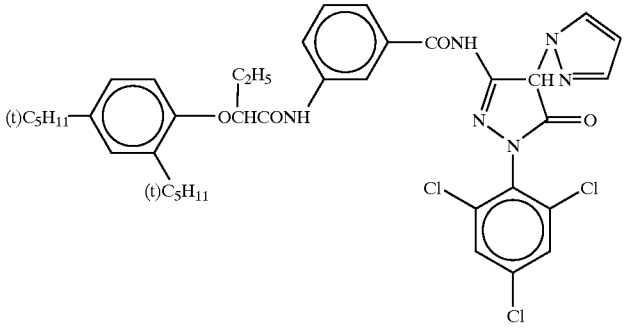

-continued
ExY-1
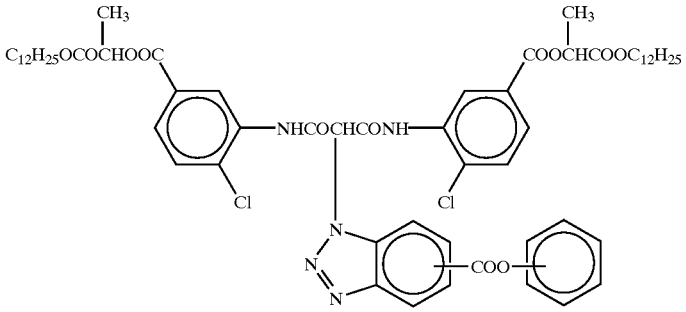
ExY-2
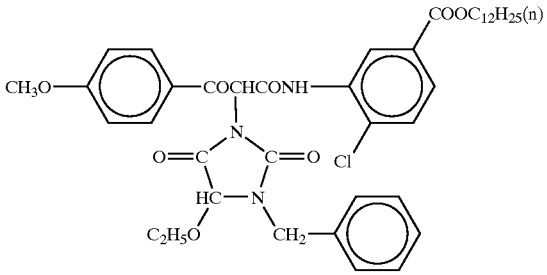
ExY-3
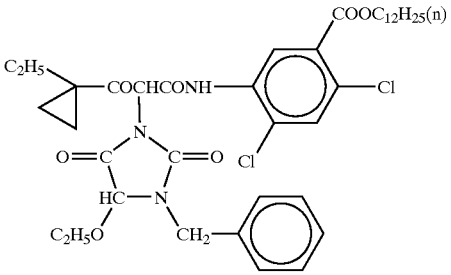
ExY-4
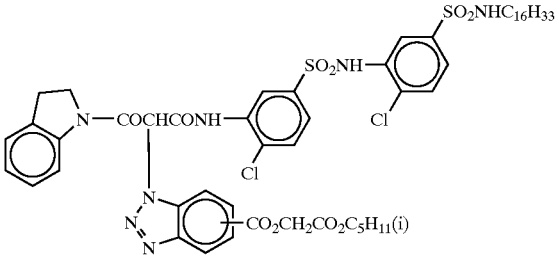
ExY-5
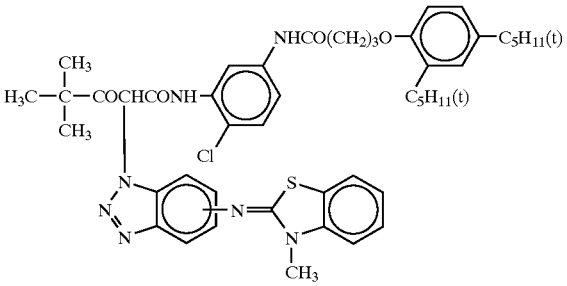
ExG-1
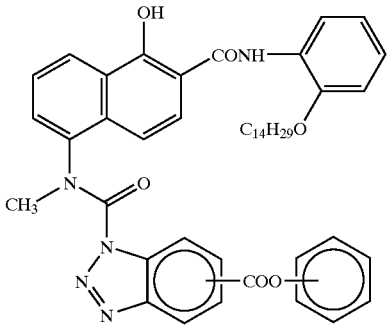
ExY-6
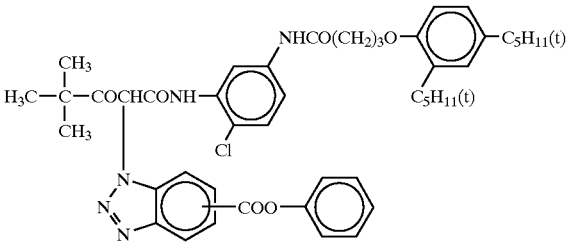
ExF-1
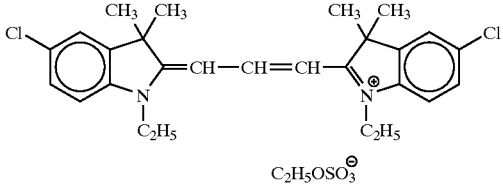
ExF-2
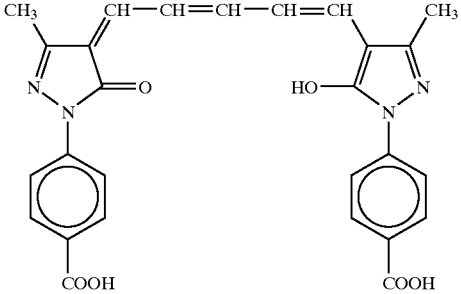

-continued
ExF-3
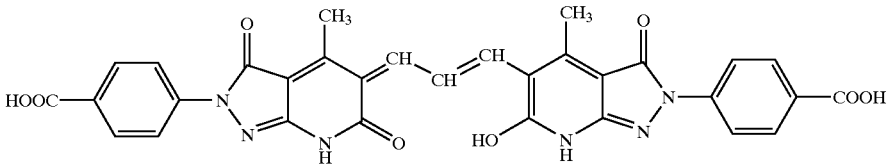
ExF-4
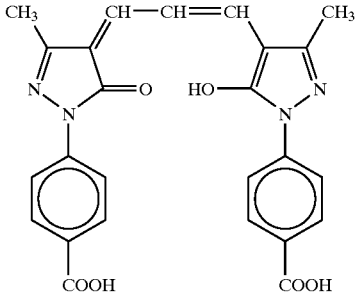
ExF-5
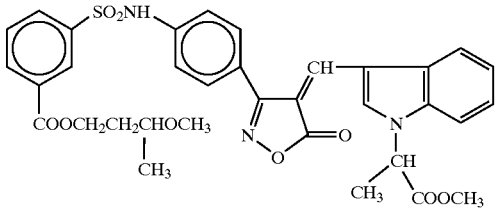
ExF-6
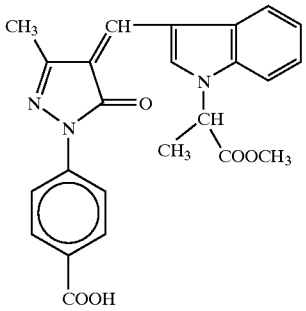
Cpd-1
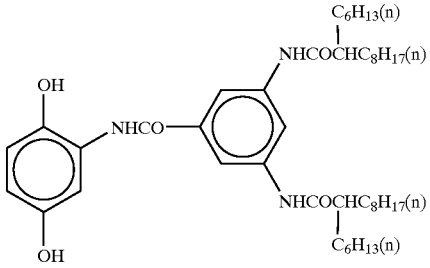
Cpd-2
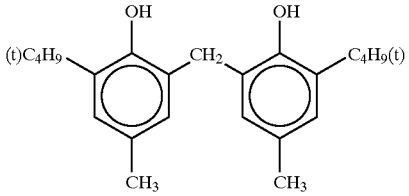
Cpd-3
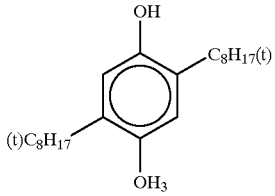
Cpd-4
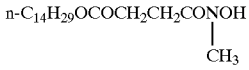
UV-1
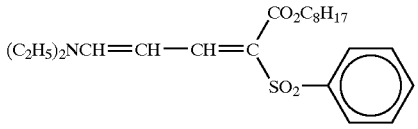
UV-2
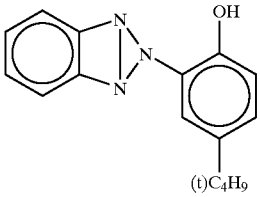
UV-3
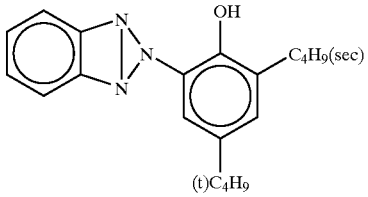
UV-4
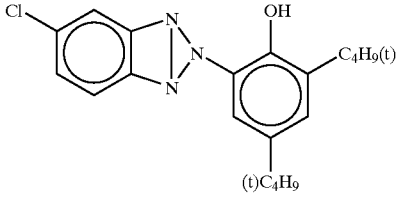
HBS-1
Tricresyl phosphate -continued
Di-n-butyl phthalate
HBS-2
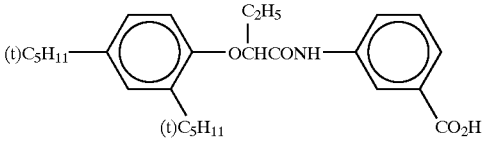
HBS-3
Tri (2-ethylhexyl) phosphate
HBS-4
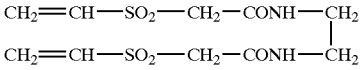
H-1
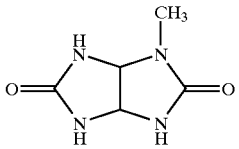
S-1
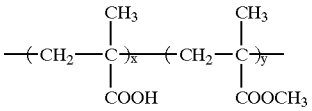
x/y = 10/90 (weight ratio)
Av. molecular weight:
about 35,000
B-1
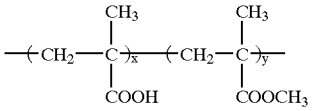
x/y = 40/60 (weight ratio)
Av. molecular weight:
about 20,000
B-2
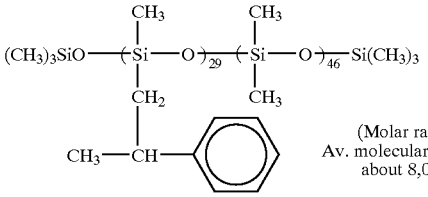
(Molar ratio)
Av. molecular weight:
about 8,000
B-3
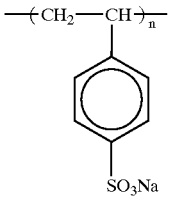
Av. molecular weight:
about 750,000
B-4
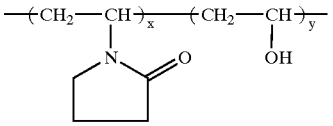
x/y = 70/30 (Weight ratio)
Av. molecular weight:
about 17,000
B-5
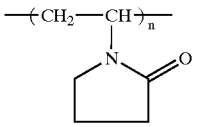
Av. molecular weight:
about 10,000
B-6
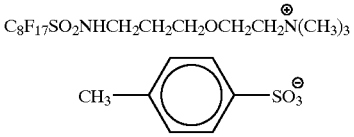
W-1
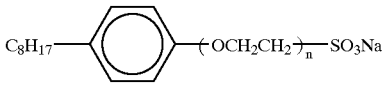
n = 2–4
W-2
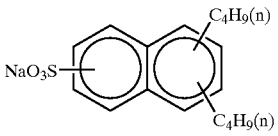
W-3
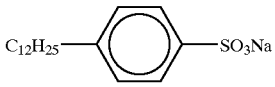
W-4
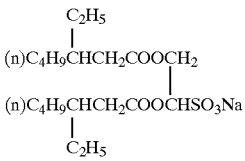
W-5

-continued
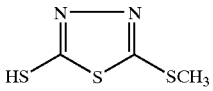
F-1
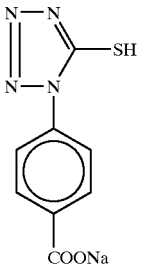
F-2
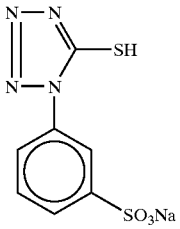
F-3
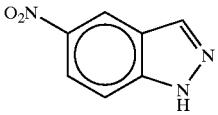
F-4
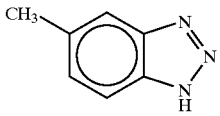
F-5
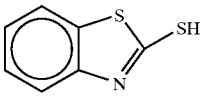
F-6
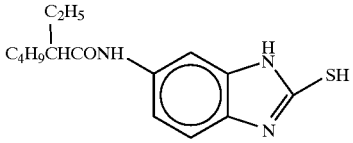
F-7
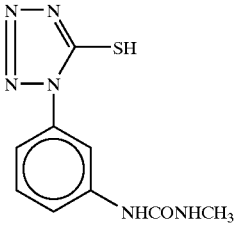
F-8
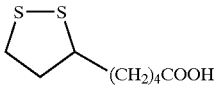
F-9
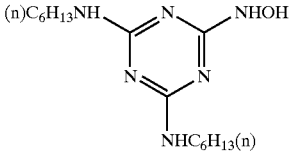
F-10
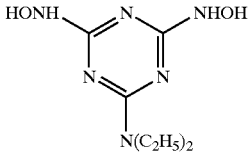
F-11
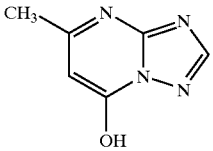
F-12
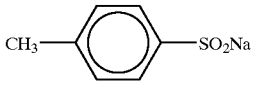
F-13
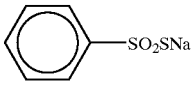
F-14
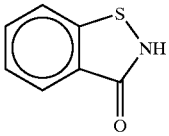
F-15
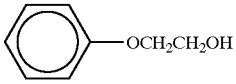
F-16
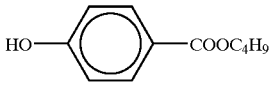
F-17
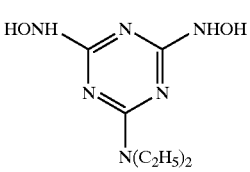
F-18

-continued

F-19

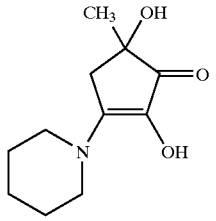

F-20

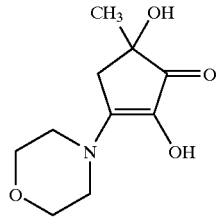

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N, N-bis(2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |

(Fixing (1) Tank Solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 7.4 | 7.45 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one · sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The density of each processed sample was measured through a red filter to evaluate its photographic properties, which are indicated using the relative value of the reciprocal of an exposure amount necessary for the cyan density to reach a density of fog density plus 0.65. The sensitivity achieved when the emulsion of the fifth layer is EM-1A is taken as 100.

The evaluation of resistance to pressure was carried out in the same manner as Example 1, provided that "rate of change in density caused by pressure" was obtained by calculating, from the formula below, the rate of change in density achieved when exposure was carried out at an exposure amount imparting a cyan density of 1.2 in a non-bent portion:

"Change in density caused by pressure"=("Density in bent portion"/1.2−1)×100 (%)

wherein the formula, 1.2 indicates the density in a non-bent portion.

The results are shown in Table 6. Similar to the results shown in Example 1, the advantage of the present invention was remarkable even in color negative multiple layers.

TABLE 6

| Emulsion in the 5th layer | Ratio of grains 0.7 Io < Is < 1.3 Io with respect to the total projected area (%) | SVA value (%) | Iodide content in an imaginary plane that is present in a depth of 20% of the grain thickness from the main plane and that is parallel to the main plane | Intensity of induced fluorescence near 575 nm *1 | Sensitivity *2 | Rate of change in density by pressure (%) |
|---|---|---|---|---|---|---|
| EM-1A Comp. | 45 | 47 | Measurement points having the maximum iodide content distribute circularly | weak | 100 | −12 |
| EM-1B Inv. | 73 | 45 | Measurement points having the maximum iodide content distribute circularly | weak | 128 | −6 |
| EM-1C Inv. | 83 | 29 | Measurement points having the maximum iodide content distribute circularly | weak | 168 | −2 |
| EM-1D Inv. | 93 | 19 | Measurement points having the maximum iodide content distribute circularly | weak | 176 | −2 |
| EM-1E Inv. | 74 | 41 | Measurement points having the maximum iodide content do not distribute circularly | weak | 106 | −10 |
| EM-1F Inv. | 93 | 25 | Measurement points having the maximum iodide content do not distribute circularly | weak | 151 | −2 |
| EM-2A Inv. | 90 | 20 | Measurement points having the maximum iodide content distribute circularly | strong | 186 | −1 |
| EM-2B Inv. | 91 | 27 | Measurement points having the maximum iodide content do not distribute circularly | strong | 160 | −1 |

*1: Intensity of induced fluorescence near 575 nm is "strong" means that the intensity thereof is one third or more of the maximum intensity of the fluorescent light emitted in the wavelength range of 490 to 560 nm. Intensity of induced fluorescence near 575 nm is "weak" means that the intensity thereof is less than one third of the fluorescent light emitted in a wavelength range of 490 to 560 nm.

*2: The sensitivity is a relative value assuming the sensitivity of Em-1A as 100.

Also, the emulsions prepared in Example 3 were similarly evaluated after their introduction in the sixth layer (high-speed red-sensitive emulsion layer) in the above color negative multiple layers, and the relative relationship was found to be the same as Example 3.

According to the present invention the sensitivity of emulsions comprising silver halide tabular grains having a grain thickness reduced to 0.1 μm or less for the purpose of enhancement in sensitivity, can be further enhanced. Additionally, variation in photographic properties caused by pressure can also be reduced. As a result, silver halide photographic light-sensitive materials having high sensitivity can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide emulsion comprising silver halide grains, wherein the variation coefficient of equivalent-circle diameters of all the silver halide grains is 40% or less, and 70% or more of the total projected area of all the grains is accounted for by silver halide grains each satisfying the following requirements (i), (ii) and (iii):

(i) a silver iodobromide or silver iodochlorobromide tabular grain having (111) planes as main planes thereof, (ii) a thickness thereof is 0.1 μm or less, and (iii) surface iodide contents in the main plane thereof meeting the following relations:

$$Io<30 \text{ mol } \% \text{ and}$$

$$0.7Io<Is<1.3Io$$

wherein "Is" is an average value of surface iodide contents (Ip's) in the main plane of each grain and "Io" is an average value of the "Is" values of all the tabular grains.

2. The silver halide emulsion according to claim 1, wherein each of the silver halide tabular grains accounting for 70% or more of the total projected area further satisfying requirement (iv) below:

(iv) the equivalent-circle diameter is 1.0 μm or more, and the variation coefficient of the distribution of the surface iodide contents (Ip's) in a silver halide grain is 30% or less, wherein the surface iodide content being measured in every measurement area all over the main plane of the silver halide grain and the measurement area being a square having a side length of 100 nm.

3. The silver halide emulsion according to claim 1, wherein in the requirement (iii), "Is" satisfies the relation: $0.8Io<Is<1.2Io$.

4. The silver halide emulsion according to claim 2, wherein in the requirement (iv), the variation coefficient of the "Ip's" is 20% or less.

5. The silver halide emulsion according to claim 1, wherein each of the silver halide tabular grains accounting for 70% or more of the total projected area further satisfying requirement (iv') below:

(iv') the equivalent-circle diameter is 3.0 μm or more.

6. The silver halide emulsion according to claim 2, wherein each of the silver halide tabular grains accounting for 70% or more of the total projected area further satisfying requirement (iv') below:

(iv') the equivalent-circle diameter is 3.0 μm or more.

7. The silver halide emulsion according to claim 1, wherein when the emulsion is irradiated with an electromagnetic wave of 325 nm under the environment of an absolute temperature of 6° K, induced fluorescence of 575 nm with an intensity of at least one third the intensity of the maximum fluorescent emission induced in the wavelength range of from 490 to 560 nm, is emitted.

8. The silver halide emulsion according to claim 5, wherein when the emulsion is irradiated with an electromagnetic wave of 325 nm under the environment of an absolute temperature of 6° K, induced fluorescence of 575 nm with an intensity of at least one third the intensity of the maximum fluorescent emission induced in the wavelength range of from 490 to 560 nm, is emitted.

9. The silver halide emulsion according to claim 1, wherein each of the silver halide tabular grains accounting for 70% or more of the total projected area further satisfying requirement (v) below:

(v) when the distribution of iodide contents is measured on an imaginary plane inside the tabular grain which is parallel to the main plane and which is present in the depth of 20% of the tabular grain thickness from the main plane, the measurement points at which the iodide content is maximum distribute in the form of a circle surrounding the center of the imaginary plane, wherein the iodide content being measured in every measurement area all over the imaginary plane and the measurement area being a square having a side length of 100 nm.

10. The silver halide emulsion according to claim 5, wherein each of the silver halide tabular grains accounting for 70% or more of the total projected area further satisfying requirement (v) below:

(v) when the distribution of iodide contents is measured on an imaginary plane inside the tabular grain which is parallel to the main plane and which is present in the depth of 20% of the tabular grain thickness from the main plane, the measurement points at which the iodide content is maximum distribute in the form of a circle surrounding the center of the imaginary plane, wherein the iodide content being measured in every measurement area all over the imaginary plane and the measurement area being a square having a side length of 100 nm.

11. The silver halide emulsion according to claim 9, wherein the iodide contents at the measurement points at which the iodide contents are maximum are within the range of from 15 mol % to 40 mol %.

12. The silver halide emulsion according to claim 10, wherein the iodide contents at the measurement points at which the iodide contents are maximum are within the range of from 15 mol % to 40 mol %.

13. The silver halide emulsion according to claim 1, wherein each of the silver halide tabular grains accounting for 70% or more of the total projected area further having 10 or more dislocation lines per grain at the peripheral portion thereof.

14. The silver halide emulsion according to claim 5, wherein each of the silver halide tabular grains accounting for 70% or more of the total projected area further having 10 or more dislocation lines per grain at the peripheral portion thereof.

15. A silver halide photographic light-sensitive material comprising at least one silver halide emulsion layer on a support, wherein the silver halide emulsion layer contains a silver halide emulsion comprising silver halide grains, wherein the variation coefficient of equivalent-circle diameters of all the silver halide grains is 40% or less, and 70% or more of the total projected area of all the grains is accounted for by silver halide grains each satisfying the following requirements (i), (ii) and (iii):

(i) a silver iodobromide or silver iodochlorobromide tabular grain having (111) planes as main planes thereof, (ii) a thickness thereof is 0.1 μm or less, and (iii) surface iodide contents in the main plane thereof meeting the following relations:

$$Io<30 \text{ mol } \% \text{ and}$$

$$0.7Io<Is<1.3Io$$

wherein "Is" is an average value of surface iodide contents (Ip's) in the main plane of each grain and "Io" is an average value of the "Is" values of all the tabular grains.

16. The silver halide photographic light-sensitive material according to claim 15, wherein each of the silver halide tabular grains accounting for 70% or more of the total projected area further satisfying requirement (iv) below:

(iv) the equivalent-circle diameter is 1.0 μm or more, and the variation coefficient of the distribution of the surface iodide contents (Ip's) in a silver halide grain is 30% or less, wherein the surface iodide content being measured in every measurement area all over the main plane of the silver halide grain and the measurement area being a square having a side length of 100 nm.

17. A silver halide photographic light-sensitive material according to claim 15, wherein each of the silver halide tabular grains accounting for 70% or more of the total projected area further satisfying requirement (iv') below:

(iv') the equivalent-circle diameter is 3.0 μm or more.

18. A silver halide photographic light-sensitive material according to claim 15, wherein when the emulsion is irradiated with an electromagnetic wave of 325 nm under the environment of an absolute temperature of 6° K, induced fluorescence of 575 nm with an intensity of at least one third the intensity of the maximum fluorescent emission induced in the wavelength range of from 490 to 560 nm, is emitted.

19. A silver halide photographic light-sensitive material according to claim 15, wherein each of the silver halide tabular grains accounting for 70% or more of the total projected area further satisfying requirement (v) below:

(v) when the distribution of iodide contents is measured on an imaginary plane inside the tabular grain which is parallel to the main plane and which is present in the depth of 20% of the tabular grain thickness from the main plane, the measurement points at which the iodide content is maximum distribute in the form of a circle surrounding the center of the imaginary plane, wherein the iodide content being measured in every measurement area all over the imaginary plane and the measurement area being a square having a side length of 100 nm.

20. A silver halide photographic light-sensitive material according to claim 15, wherein each of the silver halide tabular grains accounting for 70% or more of the total projected area further having 10 or more dislocation lines per gram at the peripheral portion thereof.

* * * * *